US011473525B2

(12) United States Patent
Ureel

(10) Patent No.: US 11,473,525 B2
(45) Date of Patent: Oct. 18, 2022

(54) ENERGY HARVESTING HEAT ENGINE AND ACTUATOR

(71) Applicant: Synergy Power LLC, Holland, MI (US)

(72) Inventor: Emil J. Ureel, Holland, MI (US)

(73) Assignee: Synergy Power LLC, Holland, MI (US)

( * ) Notice: Subject to any disclaimer, the term of this patent is extended or adjusted under 35 U.S.C. 154(b) by 0 days.

(21) Appl. No.: 17/146,284

(22) Filed: Jan. 11, 2021

(65) Prior Publication Data

US 2021/0189997 A1 Jun. 24, 2021

Related U.S. Application Data

(63) Continuation of application No. PCT/US2018/041239, filed on Jul. 9, 2018.

(51) Int. Cl.

| | |
|---|---|
| ***F02G 1/053*** | (2006.01) |
| ***F02B 53/02*** | (2006.01) |
| ***F02G 1/047*** | (2006.01) |
| ***F01B 13/06*** | (2006.01) |
| ***F01B 19/04*** | (2006.01) |
| *F02G 1/057* | (2006.01) |

(52) U.S. Cl.

CPC ..... *F02G 1/0535* (2013.01); *F01B 13/06* (2013.01); *F01B 19/04* (2013.01); *F02B 53/02* (2013.01); *F02G 1/047* (2013.01); *F02G 1/057* (2013.01)

(58) Field of Classification Search

CPC ..... F02G 1/0535; F02G 1/047; F02G 1/057; F01B 13/06; F01B 19/04; F02B 53/02

See application file for complete search history.

(56) References Cited

U.S. PATENT DOCUMENTS

| | | | | | |
|---|---|---|---|---|---|
| 4,414,814 | A * | 11/1983 | White | F02G 1/043 | 60/516 |
| 4,915,018 | A * | 4/1990 | Scott | F16J 3/06 | 92/96 |
| 5,138,936 | A * | 8/1992 | Kent | F16J 15/52 | 92/103 F |
| 5,222,466 | A * | 6/1993 | Gratziani | F01B 11/08 | 123/193.6 |
| 2012/0073298 | A1* | 3/2012 | Frem | F02B 75/222 | 60/682 |
| 2012/0073950 | A1* | 3/2012 | Kamen | F04D 25/026 | 202/187 |
| 2014/0150419 | A1* | 6/2014 | Godwin | F03G 3/00 | 60/645 |
| 2016/0290136 | A1* | 10/2016 | Ureel | F02G 1/043 | |
| 2018/0209270 | A1* | 7/2018 | Ureel | F01B 13/068 | |

* cited by examiner

*Primary Examiner* — Mickey H France

(74) *Attorney, Agent, or Firm* — The Watson IP Group, PLC; Jovan N. Jovanovic

(57) ABSTRACT

A rotary heat engine including a central crankshaft and a plurality of cylinder assemblies and a heat exchanger assembly. At least one of the plurality of cylinders, and preferably all of the plurality of cylinders includes a cylinder member, a piston member slidably positionable within the cylinder member, a connecting rod and a rolling diaphragm. The rolling diaphragm is positioned between the piston and the cylinder assembly to define a working volume which is in fluid communication with an opening that is in communication with the heat exchanger body.

9 Claims, 14 Drawing Sheets

ENERGY HARVESTING HEAT ENGINE AND ACTUATOR

CROSS-REFERENCE TO RELATED APPLICATION

This present application is a continuation of PCT Patent Application Serial No. PCT/US2018/041239, filed Jul. 9, 2018, entitled "ENERGY HARVESTING HEAT ENGINE AND ACTUATOR", the entire specification of which is hereby incorporated by reference.

BACKGROUND OF THE DISCLOSURE

1. Field of the Disclosure

The disclosure relates in general to an energy harvesting heat engine and actuator, and more particularly, to an energy heat engine that can take advantage of a temperature difference between two adjacent regions, turning the temperature difference into mechanical movement, which, in turn, can be converted into other types of energy or power, such as, for example electrical power.

2. Background Art

As the world's demands for energy increases, new ways of harnessing energy are needed. Current heat engines such as the Rankine cycle require some sort of circulation pump for the working fluid, which adds expense and consumes energy lowering overall efficiency; or a displacer in the case of some Stirling Engine topologies. Also, the invention does not transfer the working fluid between two connected different temperature containers and/or heat exchangers as in the case of the Alpha Stirling Engine topology. The heat engine described in the application does not require a circulating pump for the working fluid, and unlike the Stirling Engine, which uses a single-phase working fluid; the working fluid can be a refrigerant in the saturated vapor-liquid state for low temperature operation.

The heat engine described herein does not use up any of the working fluid. The working fluid is completely contained and recycled. The heat engine described herein transfers energy from an external heat source into mechanical energy. The heat engine described herein is closed cycled, and does not use any form of internal combustion and therefore it does not emit any exhaust. The heat engine described herein can harness heat from conduction, convection, and/or radiation.

Potential applications include, but are not limited to, harnessing energy from a solar water heater, from waste heat, from a naturally occurring thermocline, artificially created thermocline, from a salt pond thermocline, heat from chemical reactions, heat from electrical power, geothermal sources, conventional fuels such as coal, natural gas, nuclear, direct solar radiation on the ground or in space.

Certain solutions have been proposed for such engines. One such solution is shown in U.S. Pat. App. Pub. No. 2012/0073298 published to Frem. Problematically, the construction shown suffers from several drawbacks, some of which are set forth herein. First, the manner in which the refrigerant is maintained leads to substantial liquid refrigerant within the cylinder over time, generally regardless of the angle and orientation of the crankshaft. Second, there is no control of heat transfer between the heat exchanger and the cylinders themselves, resulting in fluctuating temperatures and heat transfer from both the outside and the inside refrigerant to the cylinder. Third, the bending movements introduced by the piston movement transferred to rotational movement lead to losses and stresses within the piston, cylinder and connecting rod.

SUMMARY OF THE DISCLOSURE

The disclosure is directed to a rotary heat engine. The rotary heat engine comprises a central crankshaft, a plurality of cylinder assemblies and a heat exchanger associated therewith. The central crankshaft has a first end and a second end and defining an axis of rotation. The central crankshaft further includes at least one piston attachment member having an offset axis which is offset from the axis of rotation, with at least one axially displaced coupling point about the offset axis. At least one of the plurality of cylinder assemblies (and preferably all of the cylinder assemblies) include a cylinder member, a piston member, a first connecting rod and a rolling diaphragm. The cylinder member has an elongated structure defining a bore and including a top end and a bottom end. The cylinder member is rotatably positioned about the central crankshaft so as to rotate about the axis of rotation. The cylinder member further includes an opening proximate the top end. The piston member is slidably positionable within the bore. The connecting rod has a piston coupling end coupled to the piston member. The rolling diaphragm is positioned between the piston and the top end so as to define a working volume therebetween. The rolling diaphragm has a top end, a bottom panel and an elongated portion. The top end is sealingly attached to the cylinder member proximate the top end and in fluid communication with the opening therein. The bottom panel overlays the piston so that movement of the piston rolls the elongated portion of the rolling diaphragm over itself between the piston and the bore of the cylinder member. The heat exchanger assembly is associated with the at least one cylinder assembly, and includes a heat exchanger body and a connecting pipe. The heat exchanger body includes an outer surface and an inner chamber. The heat exchanger body has a refrigerant positioned within the inner chamber. The connecting pipe has an inner bore, a heat exchanger end and a cylinder member end. The heat exchanger end is coupled to the heat exchanger body, and the cylinder member end is coupled to the opening in the cylinder member, thereby placing the inner chamber in fluid communication with the opening of the cylinder member, and the working volume of the rolling diaphragm through the opening. The rotary heat engine is further comprised of a second connecting rod and an intermediate piston coupler. The second connecting rod is coupled to the at least one axially displaced coupling point of the at least one piston attachment member. The intermediate piston coupler comprises a first attachment point and a second attachment point, the first attachment point of the intermediate piston coupler being coupled to the first connecting rod and the second attachment point of the intermediate piston coupler being coupled to the second connecting rod opposite an end of the second connecting rod coupled to the at least one axially displaced coupling point of the at least one piston attachment member.

In some configurations, the rotary heat engine is further comprised of a stabilizer bar coupled to the at least one piston attachment member, the stabilizer bar maintaining a constant substantially perpendicular orientation between the piston attachment member and the central crankshaft.

In some configurations, at least a portion of the inner chamber of the heat exchanger body remains below the opening in the cylinder member, to in turn, preclude the passage of at least some refrigerant in a liquid state from the inner chamber to the working volume.

In some such configurations, the at least a portion of the inner chamber of the heat exchanger body that remains below the opening in the cylinder member is larger than a volume of refrigerant in a liquid state within the inner chamber.

In some configurations, the heat exchanger body comprises a first material and the connecting pipe comprises a second material. The first material is more conductive to heat than the second material.

In some configurations, the heat exchanger body transfers heat faster the closer the liquid refrigerant is to the heat exchanger end of the connecting pipe.

In some configurations, the cylinder member further comprises a distal end wall at the top end of the elongated structure. The top end of the rolling diaphragm is sandwiched between the distal end wall and the top end of the elongated structure in sealed engagement. Additionally, the opening of the cylinder member extends through the distal end wall.

In some configurations, the rolling diaphragm comprises a neoprene material.

In some configurations, the distal end wall includes an insulation member positioned on an inner surface thereof.

In some configurations, insulation is positioned over at least a portion of an outer surface of the distal end wall and at least a portion of an outer surface of the elongated member.

In some configurations, the piston member is smaller than the bore such that when the rolling diaphragm is positioned between the piston member and the bore of the cylinder member. The piston member is capable of pivoting relative to the bore, to, in turn, allow the connecting rod to pivot relative to the bottom end of the elongated structure of the cylinder member.

In some configurations, the piston coupling end is rigidly coupled to an outer surface of the piston.

In some configurations, the piston member of at least one of the plurality of cylinder assemblies is fixed to the respective at least one coupling point to preclude relative rotation therebetween.

In some configurations, each of the plurality of cylinder assemblies is substantially identical, with one of the plurality of cylinder assemblies being fixed to the respective at least one coupling point to preclude relative rotation therebetween.

In some configurations, a radial cylinder coupling is rotatably fixed to the central crankshaft so as to rotate about the axis of rotation, with each of the plurality of cylinders.

In some configurations, the rotary engine further comprises a stabilizer bar to maintain each of the plurality of cylinder assemblies in a same plane, which plane is perpendicular to the axis of rotation.

In some configurations, the plurality of cylinder assemblies comprises an uneven number of cylinder assemblies, spaced substantially uniformly about the piston attachment member.

In some configurations, the at least one heat exchanger comprises one of a coiled pipe or an elongated box of pipe.

In some configurations, the intermediate piston coupler comprises a force transfer member to which the first connecting rod and the second connecting rod are coupled proximate to a first end thereof, the force transfer member pivoting proximate to a second end thereof.

The disclosure is further directed to a method. The method comprises determining a first temperature, at a first time, associated with an environment within which a rotary heat engine operates and determining a second temperature, at a second time, associated with the environment within which the rotary heat engine operates. The method further comprising decreasing a rotational speed of the rotary heat engine in response to a determination that the first temperature is greater than the second temperature and increasing the rotational speed of the rotary heat engine in response to a determination that the first temperature is less than the second temperature.

In some embodiments, the decreasing is comprised of applying a braking force to the rotary heat engine.

In some embodiments, the decreasing and the increasing comprises decreasing and increasing, respectively, a rotational speed of the rotary heat engine to a first rotational speed in response to a determination that the first temperature is greater than a first threshold and decreasing and increasing, respectively, a rotational speed of the rotary heat engine to a second rotational speed in response to a determination that the second temperature is greater than a second threshold.

In some embodiments, the determining the first temperature comprises determining, at the first time, a first temperature difference between a hot region associated with the rotary heat engine and a cold region associated with the rotary heat engine, the determining the second temperature comprises determining, at the second time, a second temperature difference between the hot region associated with the rotary heat engine and a cold region associated with the rotary heat engine, and the decreasing and the increasing comprises decreasing and increasing, respectively, a rotational speed of the rotary heat engine to a first rotational speed in response to a determination that the first temperature difference is greater than a first threshold and decreasing and increasing, respectively, a rotational speed of the rotary heat engine to a second rotational speed in response to a determination that the second temperature difference is greater than a second threshold.

In some embodiments, the decreasing the rotational speed of the rotary heat engine is in response to the first temperature being greater than the second temperature by a threshold amount.

In some embodiments, the threshold amount is a first threshold amount, wherein the increasing the rotational speed of the rotary heat engine is based on a determination that first temperature is less than the second temperature by a second threshold amount.

In some embodiments, the decreasing the rotational speed of the rotary heat engine comprises increasing a duty cycle percentage of a power converter associated with the rotary heat engine based on the determination that first temperature is greater than the second temperature.

In some embodiments, the increasing the rotational speed of the rotary heat engine comprises decreasing a duty cycle percentage of the power converter based on a determination that first temperature is less than the second temperature by a threshold amount.

The disclosure is further directed to another method. The method comprises regulating a temperature of an environment of a rotary heat engine, the environment comprised of a hot region and a cold region and determining if the temperature of the environment is greater than a threshold. The method further comprises, if the temperature is greater than the threshold, determining if the rotary heat engine is producing mechanical power, and, if the temperature is not greater than the threshold, continuing to determine if the temperature of the hot region is greater than the threshold.

The method yet further comprises, if the determining if the rotary heat engine is producing mechanical power determines that the rotary heat engine is not producing power, increasing a temperature of a heat exchanger assembly of the rotary heat engine, and, if the determining if the rotary heat engine is producing mechanical power determines that the rotary heat engine is producing power, operating the rotary heat engine without the power from the external power source external to the rotary heat engine.

In some embodiments, the determining if the temperature of the environment is greater than the threshold comprises determining if a temperature difference between a hot region of the environment and the cold region of the environment is greater than the threshold.

In some embodiments, the determining if the rotary heat engine is producing mechanical power comprises determining if a generator coupled to the rotary heat engine is generating electrical current greater than a threshold current.

In some embodiments, the rotating the rotary heat engine comprises rotating the rotary heat engine with power from an external power source external to the rotary heat engine.

In some embodiments, the rotating the rotary heat engine with power from an external power source external to the rotary heat engine comprises powering the generator with a battery to operate the generator as a motor to rotate the rotary heat engine.

In some embodiments, the external power source comprises at least one of an external mechanical power source and an external electrical power source.

In some embodiments, the method further includes heating a cylinder assembly of the rotary heat engine to a temperature greater than a temperature of a heat exchanger body of the rotary heat engine to force refrigerant to condensate in the heat exchanger body of the rotary heats engine.

BRIEF DESCRIPTION OF THE DRAWINGS

The disclosure will now be described with reference to the drawings wherein.

DETAILED DESCRIPTION OF THE DISCLOSURE

Figure 1:
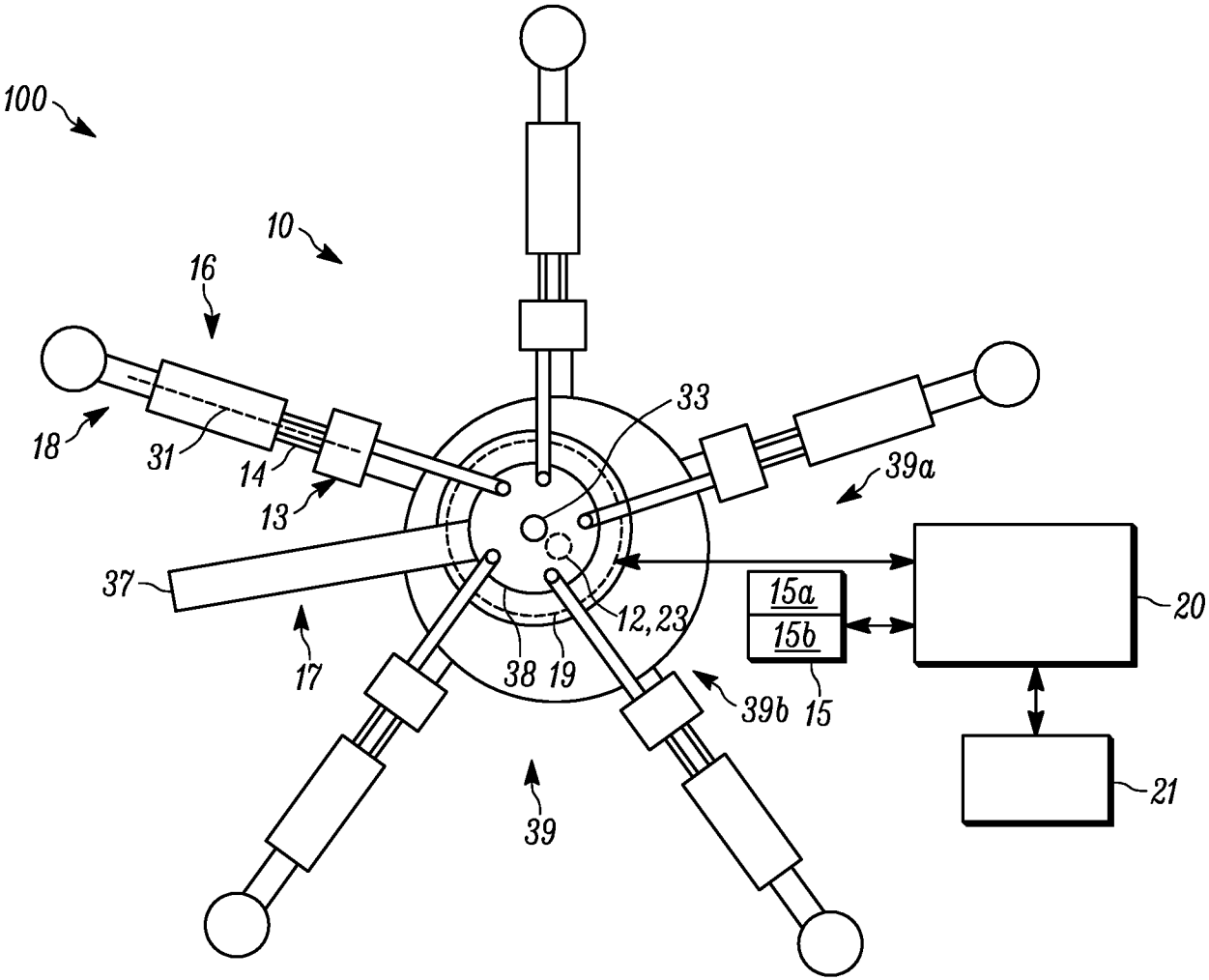
FIG. 1 illustrates a schematic top plan view of a configuration of the example rotary heat engine, in accordance with a possible embodiment.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Figure 2:
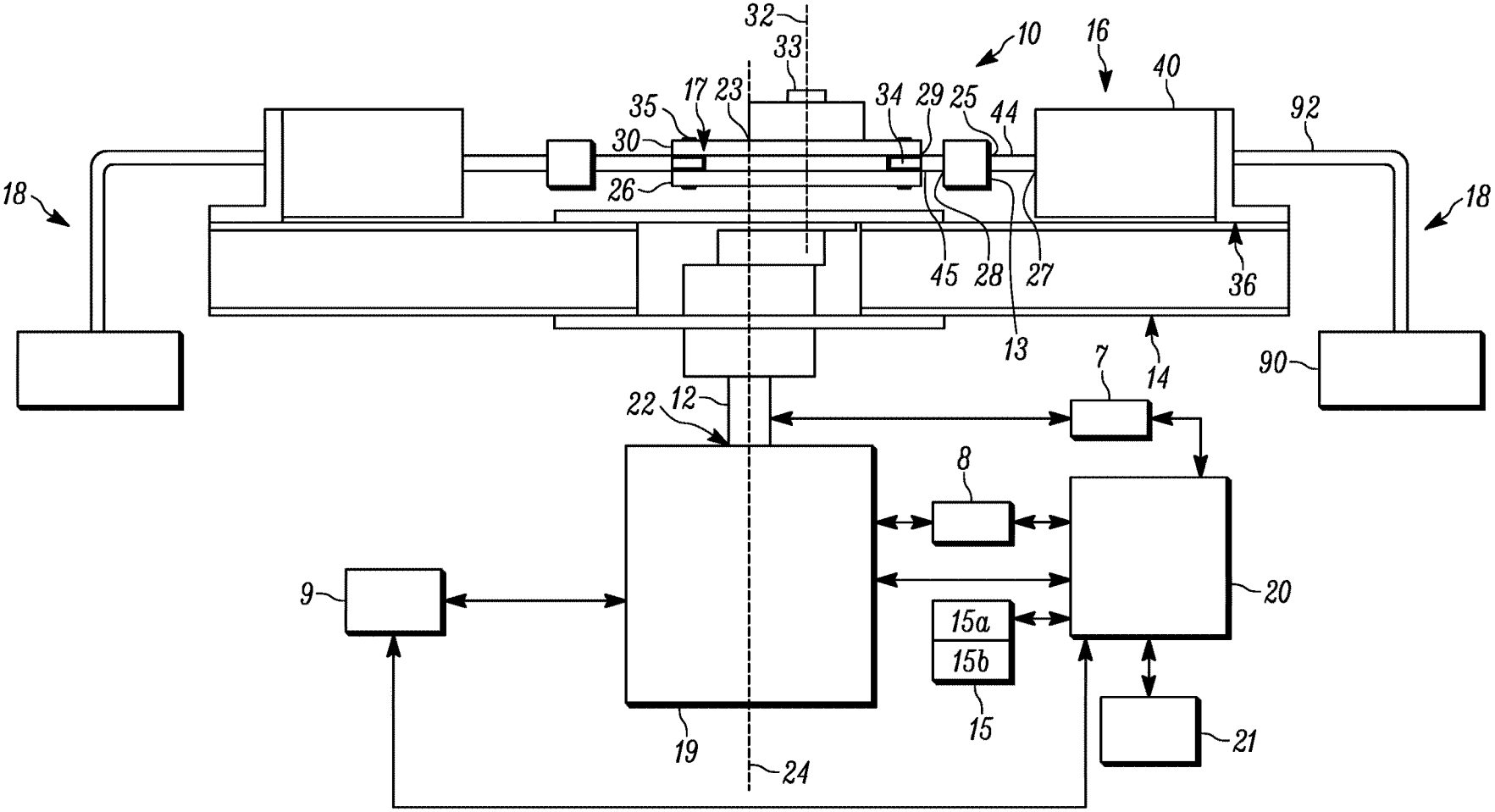
FIG. 2 illustrates a schematic side elevational view of the configuration of the example rotary heat engine that is shown in FIG. 1, in accordance with a possible embodiment.

Referring now to the drawings and in particular to FIGS. 1 and 2, the rotary heat engine is shown generally at 10. As will be explained, the rotary heat engine 10 is essentially powered by the phase change and expansion of gasses within a sealed working volume and heat exchanger, due to a change in temperature experienced by portions of the rotary heat engine. In the preferred configuration, although not required, the rotary heat engine is configured to have a plurality of cylinders arranged in a rotary configuration with a heated side and a cooled side opposite the heated side. The rotary heat engine 10 can be utilized to create electrical power through the coupling with a generator or an alternator or other mechanical to electrical converting device. The generated electrical power can be used or supplied back to a utility. The rotary heat engine 10 is not limited to the configuration shown, and is not limited to any particular field of use or application, or, limited to the generating of electrical energy. It is contemplated that the rotary heat engine 10 can be utilized in place of other mechanisms, systems and equipment for the generation of electrical energy or for the generation of mechanical energy.

The rotary heat engine 10 is shown in FIGS. 1 and 2 as comprising a central crankshaft 12, an offset crankshaft 33, an intermediate piston coupler 13, a radial cylinder coupling 14, a cylinder assembly 16, a stabilizer bar 17, and a heat exchanger assembly 18. In the configuration shown, the central crankshaft 12 is shown as being substantially vertical. It will be understood that in other configurations, the central crankshaft 12 may be oblique so as to be neither vertical nor horizontal. In still further configurations, the central crankshaft 12 may be substantially horizontal. The central crankshaft 12, in the configuration shown, has a first end 23 and a second end 22. The first end, in the configuration shown, is at the top with the second end 22 at the bottom. The central crankshaft 12 further includes an axis of rotation 24 that may be in a vertical orientation, a horizontal orientation or an oblique orientation, as explained above. Depending on the size of the rotary heat engine 10, the height, and the thickness of the central crankshaft 12 will be varied so as to be able to take the loads that are applied thereto by the multiple cylinder assemblies 16 that are coupled thereto.

With further reference to FIG. 2, the central crankshaft 12 further includes at least one piston attachment member, such as piston attachment member 26 that is coupled to the offset crankshaft 33. The piston attachment member 26, in the configuration shown, comprises a planar member having an outer perimeter 30, an offset axis 32 and a plurality of axially displaced cylinder assembly coupling points, such as coupling point 34. In the configuration shown, the piston attachment member 26 is in a plane that is perpendicular to the axis of rotation 24 of the central crankshaft 12. In other configurations, it is contemplated that the piston attachment member 26 may be oblique thereto. In addition, in the configuration shown, the piston attachment member 26 has a substantially circular outer perimeter centered about the offset axis 32 which is offset a predetermined distance from the axis of rotation 24. In turn, each of the coupling points 34 are spaced apart radially proximate the outer perimeter 30 of the piston attachment member 26 so that they are generally equidistant from the offset axis 32. As such, it is contemplated that the cylinder assemblies 16 are generally positioned in the same plane relative to each other, and generally in the same plane (or a parallel plane) as the piston attachment member 26.

In some embodiments, the cylinder assembly 16 is coupled to the piston attachment member 26 via the intermediate piston coupler 13. A first connecting rod 44 is coupled to a first end 25 of the intermediate piston coupler 13. The intermediate piston coupler 13 includes a second end 28 that is coupled to a second connecting rod 45. The first connecting rod 44 includes a first end 27 that is coupled to the cylinder assembly 16 and a second end that is coupled to the intermediate piston coupler 13. The second connecting rod 45 includes a first end 28 that is coupled to the intermediate piston coupler 13 and a second end 29 that is coupled to the piston attachment member 26.

The intermediate piston coupler 13 receives mechanical pushing and pulling forces produced by the cylinder assembly 16 on the first connecting rod 44. The intermediate piston coupler 13 transfers these mechanical forces to the second connecting rod 45. The intermediate piston coupler 13 translates these mechanical forces into offset forces, that is offset from a central axis 31 of the first connecting rod 44, that are applied to the second connecting rod 45. The offset forces allow the intermediate piston coupler 13 to substantially eliminates side loading, that is pushing of the piston member 42 against the rolling diaphragm 46 (FIGS. 3, 4A-4C) within the cylinder assembly 16. Moreover, the intermediate piston coupler 13 reduces the pivot angle of the piston member 42 (FIG. 4A-4C) relative to the cylinder member 40. Furthermore, the intermediate piston coupler 13 allows for stroke multiplication or reduction.

The stabilizer bar 17 is coupled to the piston attachment member 26. The stabilizer bar includes a first end 37 and a second end 38. The first end 37 is fixed to a stationary object (not shown), such a housing (not shown) for the rotary heat engine 10. The second end 38 of the stabilizer bar 17 is coupled to the piston attachment member 26 via fasteners 35. In some configurations, the fasteners 35 are bolts, although other types of fasteners can be used. Sandwiched between the stabilizer bar 17 and the piston attachment member 26 is the distal end 78 of the second end 29 of the second connecting rod 45. This distal end 78 is free to move about the fastener 35 at the location between the stabilizer bar 17 and the piston attachment member 26. The stabilizer bar 17 maintains a constant substantially perpendicular orientation between the piston attachment member 26 and the central crankshaft 12.

It is contemplated that the cylinder assemblies 16 may be positioned in different planes, and that there may be more than one piston attachment member 26. That is, there may be a separate piston attachment member 26 for a group of cylinder assemblies 16, or a separate piston attachment member 26 for each cylinder assembly 16. In still other configurations, the central crankshaft 12 may include lobes or bends which may define a piston attachment member, these may be in different planes for each cylinder assembly 16, or may provide a coupling for multiple cylinder assemblies 16. Thus, the central crankshaft 12 may have the appearance of a generally uniform rod-like member with a plurality of bends or lobes along the length thereof. The purpose of the central crankshaft 12 is to take the generally linear movement of the cylinder assembly 16 and convert the same to a rotative movement. It is contemplated that there are a number of different variations to achieve the same. Moreover, although the example rotary heat engine 10 illustrates use of five (5) cylinder assemblies 16 and their associated components, in another embodiment the rotary heat engine 10 can include more cylinder assemblies 16 than that illustrated. Likewise, in other embodiments the rotary heat engine 10 can include less cylinder assemblies 16 than that illustrated.

The radial cylinder coupling 14 is shown in the configuration of FIGS. 1 and 2 as comprising a hoop-like member to which components of the cylinder assembly are coupled, at, for example, attachment points 36. The hoop-like member is coupled, directly or indirectly, to the central crankshaft so as to have an axis of rotation that corresponds to the axis of rotation 24 and it is spaced apart from the piston attachment member 26, and in particular, the outer perimeter 30 thereof. The hoop-like member is preferably in a parallel plane to the piston attachment member 26 of the central crankshaft (and in some configurations, the radial cylinder coupling may comprise multiple interacting structures that are in independent and different planes). In the configuration shown, and as will be discussed below, each one of the cylinder members 40 are coupled to an attachment point 36 of the hoop-like member. In the configuration shown, the cylinder members 40 are fixedly attached to the attachment points, whereas in other configurations, the cylinder members 40 can be pivotably or rotatably or flexibly coupled to the radial cylinder coupling 14, which allows for some relative movement of the cylinder member 40 vis-a-vis the radial cylinder coupling. It is further contemplated that for some designs, the cylinder members 40 can be integrally formed with the radial cylinder coupling. In still other configurations, especially wherein the cylinder assemblies are in different planes, it is contemplated that there may be a plurality of radial cylinder couplings. It is further contemplated that while the radial cylinder coupling is shown as having the cylinder members 40 extend radially outwardly therefrom, other configurations, wherein the radial cylinder coupling is further inboard or outboard relative to the cylinder members 40, are likewise contemplated.

In some embodiments, the rotary heat engine 10 is part of a system 100 that further includes the controller 20, such as a microprocessor, a microcontroller, a personal computer, or any other controller that can perform the functions described herein, an electrical generator 19, a temperature sensor 15, such as a Negative Temperature Coefficient (NTC) thermistor, Resistance Temperature Detector (RTD), Thermocouple, a semiconductor-based sensors, or any other temperature sensor, a power converter 21, such as a direct current (DC) to DC converter, and a braking system 7 coupled to the rotary heat engine 10, such as coupled to the central crankshaft 12. The braking system 7 can be a mechanical, electrical, pneumatic, hydraulic, or any other braking system that can apply braking forces, e.g., varying braking forces, to the rotary heat engine 10. The generator 19 produces power when rotated by the rotary heat engine 10. Although the generator 19 is illustrated as being attached to the central crankshaft 12, in other embodiments the generator 19 can be coupled to the central crankshaft 12 via an intermediate component(s), such as one or more belts, one or more gears, and/or one or more chains. In some embodiments, the generator 19 is used to charge a battery 9. In some embodiments, the system 100 further includes an external power source 8, such as at least one of an external mechanical power source or an external electrical power source, such as pneumatic, hydraulic, spring, or any other power source that can be used to rotate the rotary heat engine 10, and in some embodiments under control of the controller 20. In some embodiments, the system 100 can further include the braking system 7. The braking system 7 reduces the rotational speed of the rotary heat engine 10. In some embodiments, the braking system 7 is coupled to and under the control of the controller 20.

In some embodiments in which the rotary heat engine 10 is operated in an environment in which heat is a limited quantity, the controller 20 controls how fast the rotary heat engine 10 turns to maximize use of the available heat. To maximize use of the available heat, the controller 20 controls the rotary heat engine 10 so as to not consume heat faster that is being applied to the environment in which the rotary heat engine 10 is operated. Likewise, the controller 20 controls the rotary heat engine 10 so as to not waste heat that is being applied to the environment in which the rotary heat engine 10 is operated. The controller 20 measures an amount of heat within the environment via the temperature sensor 15 that comprises a hot region temperature sensor 15*a* and a cold region temperature sensor 15*b*. Although a single hot region temperature sensor 15*a* and cold region temperatures sensor 15*b* are shown in FIG. 1, the hot region temperature sensor 15*a* and cold region temperatures sensor 15*b* can be implemented with a plurality of temperatures sensors. The controller 20 compares heat measurements over time to determine if the heat within the environment is increasing or decreasing. If the heat is increasing within the environment, the controller 20 controls a duty cycle percentage of the power converter 21 to cause the rotary heat engine 10 to turn faster and therefore consume more heat from the environment. Likewise, if the heat is decreasing within the environment, the controller 20 controls a duty cycle percentage of the power converter 21 to cause the rotary heat engine 10 to turn slower and therefore consume less heat from the environment.

Figure 3:
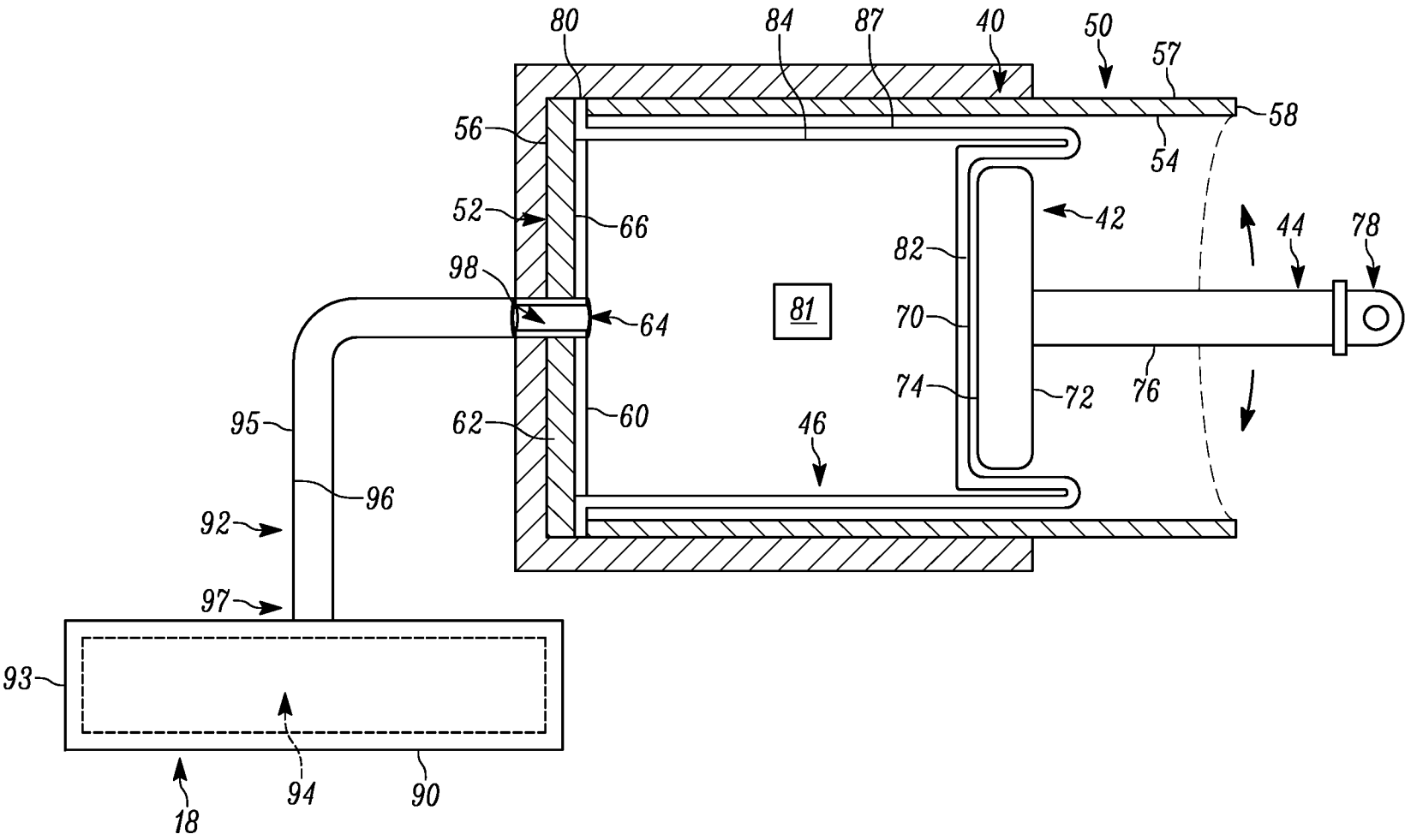
FIG. 3 illustrates a schematic cross-sectional view of an example cylinder assembly and example heat exchanger assembly, in accordance with a possible embodiment.

The cylinder assembly 16 is shown in greater detail in FIG. 3 as comprising the cylinder member 40, piston member 42, the first connecting rod 44, and rolling diaphragm 46. In the configuration shown, there are a plurality of cylinder assemblies, each of which are coupled by way of the cylinder member 40 to the radial cylinder coupling 14 and spaced apart from each other there along. In the configuration shown, the piston member 42 of each of the cylinder assemblies is coupled to the piston attachment member 26 of the central crankshaft 12 (FIGS. 1 and 2).

The cylinder member 40 is shown as comprising elongated structure 50 and distal end wall 52. The elongated structure 50 includes inner surface 54 that defines inner chamber (i.e., also often known as the cylinder bore) and outer surface 57 extending therearound. The elongated structure has top end 56 and bottom end 58 and generally comprises a substantially uniform cylindrical cross-section, although other configurations are contemplated (including, but not limited to, oval, elliptical, rectangular, polygonal). In some configurations, portions along which the piston travels may be substantially uniform in cross-section, with other portions being of a different cross-sectional configuration.

The distal end wall 52 is positioned at the top end 56 of the elongated structure 50 and includes inner surface 60, outer surface 62 and opening 64. In the configuration shown, the distal end wall 52 comprises a substantially planar member that is substantially perpendicular to a central axis of the elongated structure 50, although variations, such as hemispherical or otherwise, are also contemplated. The opening 64, in the configuration shown, is positioned so as to substantially correspond to the central axis of the elongated structure 50. In other configurations, the opening 64 may be offset so as to be closer to the inner surface 54 of the elongated structure. In other configurations, the opening 64 may comprise a plurality of openings that are spaced apart from each other along the distal end wall. In still other configurations, the opening 64 may be formed in the elongated structure proximate the top end. It is further contemplated that in some configurations, a conical structure or an outwardly convex structure may form the distal end wall, which structure may include one or more openings extending thereon.

Figure 6:
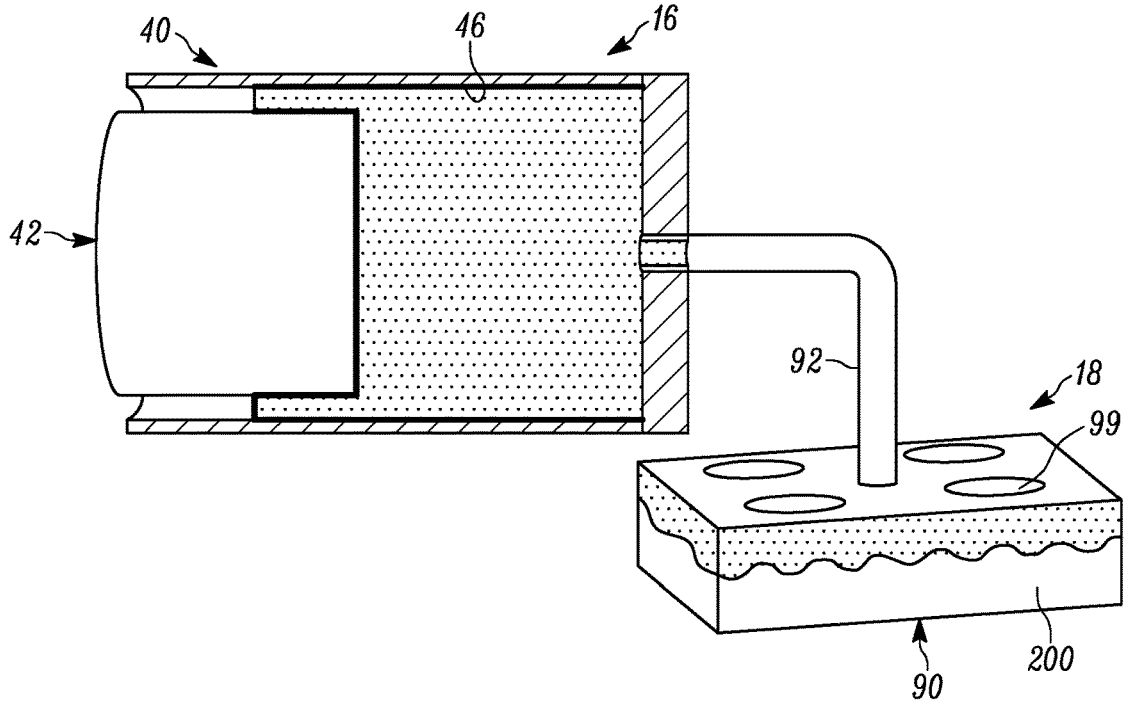
FIG. 6 illustrates a partial schematic cross-sectional view of the example configuration of FIG. 5, showing the liquid and gas refrigerant within the example heat exchanger and the example cylinder member and in particular the working volume defined by an example rolling diaphragm, in accordance with a possible embodiment.

The outer surface 57 of the elongated structure 50 and the outer surface 62 of the distal end wall may both include an insulation extending thereover, as is further shown in FIG. 6. Such insulation may comprise a sprayed-on insulation, a blanket or other flexible insulation, rigid insulation that is adhered or otherwise generally coupled (through an interference fit or the like) to the outer surfaces. Such insulation limits that temperature variation of the cylinder assembly 16 so as to minimize the temperature fluctuation of the cylinder assembly 16 (thereby improving the control of the refrigerant that is utilized therewith).

It is contemplated that the bottom end 58 of the elongated structure 50 of the cylinder member 40 may be open. Such a configuration allows for the relative movement of the connecting rod bounded only by the bottom end 58 of the elongated structure 50. In other configurations, a bottom end wall or the like may be employed with an opening configured to allow for the connecting rod to pass therethrough. In some such configurations, a linear bearing or the like may be provided, which linear bearing may be capable of pivoting.

The piston member 42 is shown in FIG. 3 as comprising inner surface 70, outer surface 72 and side interfacing surface 74. The piston member 42 is configured to be slidably positionable along the elongated structure 50 between the top end and the bottom end thereof, with the understanding that the actual movement of the piston from its closest position relative to the bottom end and the closest position relative to the top end being defined as the stroke. The inner surface 70 generally faces the top end 56 with the outer surface 72 facing the bottom end 58.

The first connecting rod 44 includes the piston coupling end 76 and distal end 78. In the configuration shown, the piston coupling end 76 is generally coupled to a centrally located portion of the outer surface 72 of the piston member. The distal end 78 may be pivotably or fixedly coupled to the piston attachment member 26 of the central crankshaft (FIG. 3). Depending on the cylinder assembly 16, and the configuration, it is often the case that one cylinder assembly 16 will have a distal end that is fixedly coupled to the piston attachment member 26, whereas the others are pivotably coupled thereto.

Furthermore, it is contemplated that the piston coupling end 76 is fixedly coupled to the outer surface 72 of the piston member. In other configurations, however, it is contemplated that the piston coupling end is pivotably coupled to the outer surface 72 of the piston member, such as through a pivoting coupling configuration, or through a ball and socket type joint for example, so as to allow the first connecting rod 44 some angular displacement relative to the outer surface 72 of the piston member.

The rolling diaphragm 46 is shown in FIG. 3 as comprising top end 80, bottom panel 82 and elongated portion 84. The rolling diaphragm 46 essentially surrounds or forms the inner wall of the expansion and contraction chamber within the cylinder assembly 16. The top end 80 is typically coupled proximate the top end 66 of the elongated structure. In the contemplated configuration, the top end 56 is sandwiched between the top end 56 of the elongated structure and the inner surface 60 of the distal end wall 52. The elongated portion 84 extends along the inner surface 54 and can be shape matingly configured so as to match the inner surface. The bottom panel is configured to extend across the bore and be generally coupled to or to overlie the inner surface 70 of the piston member 42. In the configuration shown, as the piston slides toward and away from the top end 56 of the elongated structure, a portion of the elongated portion 84 of the rolling diaphragm 46 will fold over itself with the piston traversing inside thereof. As such, the rolling diaphragm 46 forms an impervious bladder or the like to contain the gasses within the elongated structure between the distal end wall and the piston member 42, and define a working volume.

In the configuration shown, the rolling diaphragm 46 comprises a neoprene material that is of very low friction (when folded over itself between the piston and the inner surface of the elongated structure of the cylinder member) and also impervious to the gasses that are contemplated for use. In other embodiments, the rolling diagraph 46 can be comprised of chloroprene rubber, polychloroprene, Baypren, or any other type of material that can act as a rolling diaphragm. Such a rolling diaphragm 46 is likewise suitable for use at elevated pressures, such as, for example, pressures of the likes of 200 psi. Of course, modifications can be made to the properties of the rolling diaphragm 46 to accommodate higher or lower pressures, and the disclosed pressures are merely exemplary and not to be deemed limiting. In some embodiment, to decrease friction within of the rolling diaphragm 46 and against the cylinder member 40, the rolling diaphragm can be lubricated with an appropriate lubricant. In some embodiments, the walls of the cylinder member 40 and the skirt of the piston member 42 can be polished to reduce friction of the rolling diaphragm 46 and against the cylinder member 40.

The rolling diaphragm 46 further forms an insulative layer along the inner surface of the cylinder. In some configurations, it is contemplated that an additional layer of insulation may be positioned on the inner surface of the distal end wall 52 of the cylinder member 40. In other configurations, the rolling diaphragm 46 may have a configuration that extends over the distal end wall 52 with an opening that is fixedly positioned about the opening 64 of the distal end wall 52. In still other configurations, the rolling diaphragm 46 may have its top end 80 spaced apart from the distal end wall 52, for example, so that it is limited to the stroke of the piston, with, for example, different insulation between the top end of the rolling diaphragm 46 and the distal end wall 52. In some embodiments, a heater 81 is disposed proximate to the cylinder assembly 16, either within the cylinder assembly 16 or on a surface thereof.

Figure 4A:
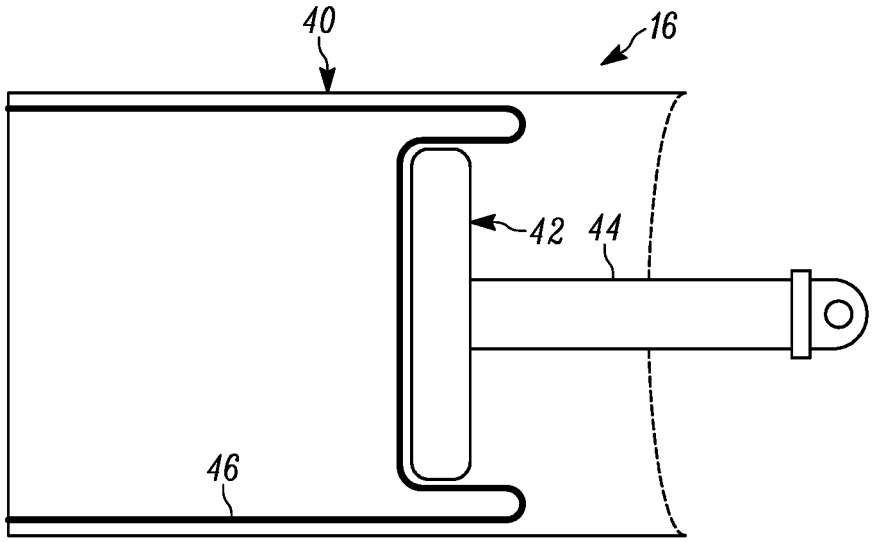
FIGS. 4A through 4C illustrate schematic cross-sectional views of an example cylinder assembly showing, in particular, the example pivoting of the piston and the connecting rod within the bore of the cylinder member, in accordance with a possible embodiment.
Figure 4B:
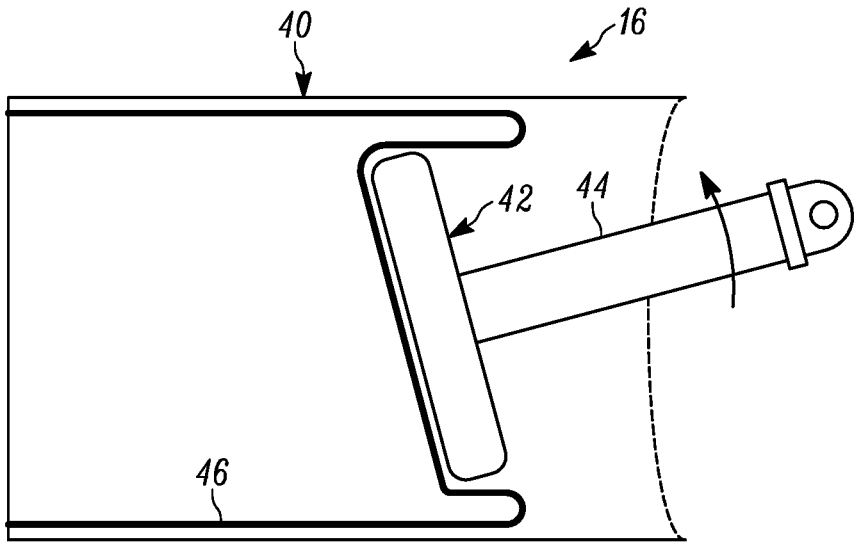
Figure 4C:
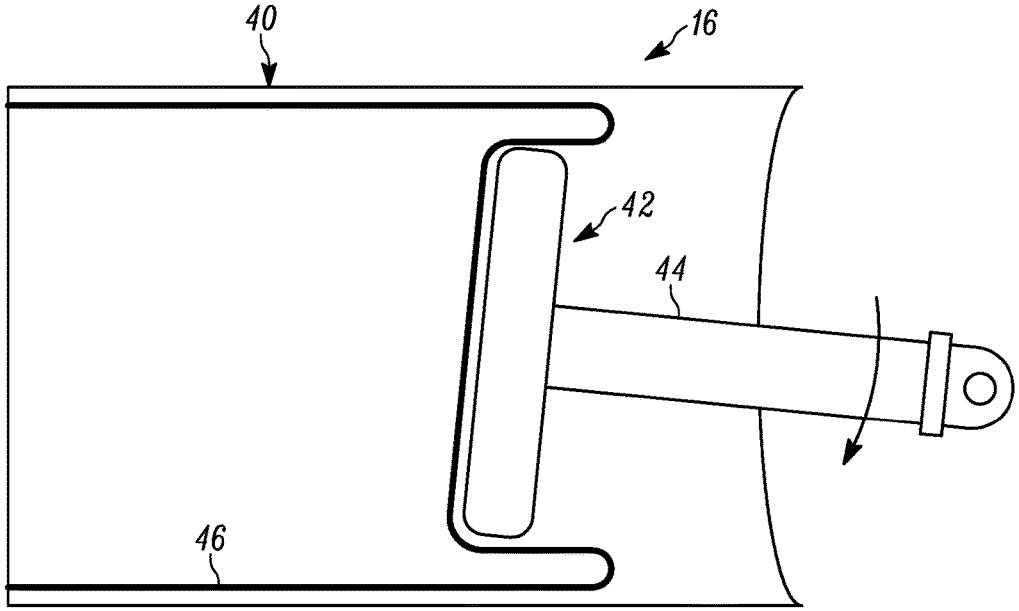

With additional reference to FIGS. 4A through 4C, with the use of the rolling diaphragm 46, the piston size is smaller than if there was no rolling diaphragm, as there may be multiple layers of the rolling diaphragm 46 between the piston and the inner surface of the elongated structure of the cylinder member 40. Advantageously, this allows the piston to float within the cylinder member 40, combined with the flexibility of the rolling diaphragm 46, the piston can rotate within the cylinder member 40 (FIGS. 4*b* and 4*c*), which results in a larger displacement of the distal end of the connecting rod. For a rotary engine, a bending moment is typically created by the back and forth pivoting of a piston as the engine spins around a fixed axis. Often, a pivot point is created, which is configured to pivot or bend to compensate for the bending movement. Problematically, these can be areas of high stress, and these can be detrimental to efficiency. By allowing the piston to float relative to the cylinder member 40, the bending movement is compensated through pivoting and rotation of the piston member. This also allows for direct coupling of the connecting rod to the piston attachment member of the central crankshaft. It will be understood that the connecting rods can be increased to limit the amount of required pivoting, among other geometric changes to the offset axis and the like.

The heat exchanger assembly 18 is shown in FIG. 3 as comprising heat exchanger body 90 and connecting pipe 92. The heat exchanger body 90 is positioned proximate the cylinder member 40 with the connecting pipe 92 extending between the heat exchanger body 90 and the cylinder member 40 (and in the configuration shown, the opening 64 in the distal end wall 52 of the cylinder member 40). As discussed above, the rotary heat engine 10 is essentially powered by the phase change and expansion of gasses within a sealed working volume and heat exchanger body 90, due to a change in temperature experienced by portions of the rotary heat engine 10. This change is temperature is the result of the rotary heat engine 10, and specifically the heat exchanger body 90 absorbing and dissipating heat from and to, respectively, an environment 39 within which the rotary heat engine 10 operates within, the environment 39 including a hot region 39*a* and a cold region 39*b*, the controller 20 sensing a temperature of the hot region 39*a* via the hot region temperature sensor 15*a*. In some embodiments, the cold region 39*b* is assumed to remain at a substantially constant temperature, obviating a need for a cold temperature sensor 15*b*. However, in other embodiments the controller 20 does sense a temperatures of the cold region 39*b* via the cold temperature sensor 15*b*.

In more detail, the heat exchanger body 90 includes outer surface 93 and inner chamber 94. Preferably, the heat exchanger body 90 is formed from a material that is generally low mass and highly thermally conductive. One such example would be a heat exchanger body 90 formed from copper or an alloy thereof. Of course, this is not to be deemed limiting, but only exemplary. The heat exchanger body 90, in the configuration shown may comprise a coiled pipe in some configurations. In other configurations, a cylindrical member having large top and bottom surfaces with a side surface therebetween is contemplated for use. Such a configuration may include passageways, such as passageways 99, to facilitate a greater surface area for contact with the heating and cooling sources, so as to improve the performance thereof. In other configurations, a cubic member having relative large top and bottom surfaces with smaller side surfaces is contemplated. Again, passageways 99 (FIG. 5) may extend therethrough to facilitate heat transfer. Of course, other configurations are likewise contemplated. Preferably, the surface area of the heat exchanger body 90 is relatively large for the volume of the inner chamber, which improves performance.

The connecting pipe is shown in FIG. 3 as including outer surface 95, inner bore 96, heat exchanger end 97 and cylinder member end 98. In the configurations shown, the connecting pipe comprises a pipe of a substantially uniform configuration (which may be bent along the length thereof). The inner bore 96 is therefore generally uniform, although variations are contemplated. Preferably, the connecting pipe is of a material that is insulative, or is coated with an insulation, such that the effects of the outside heating and cooling sources can be minimized. The heat exchanger end 97 is coupled to the cylinder member end 98 so that the inner bore 96 is in fluid communication with the inner chamber 94 of the heat exchanger body 90.

Figure 7:
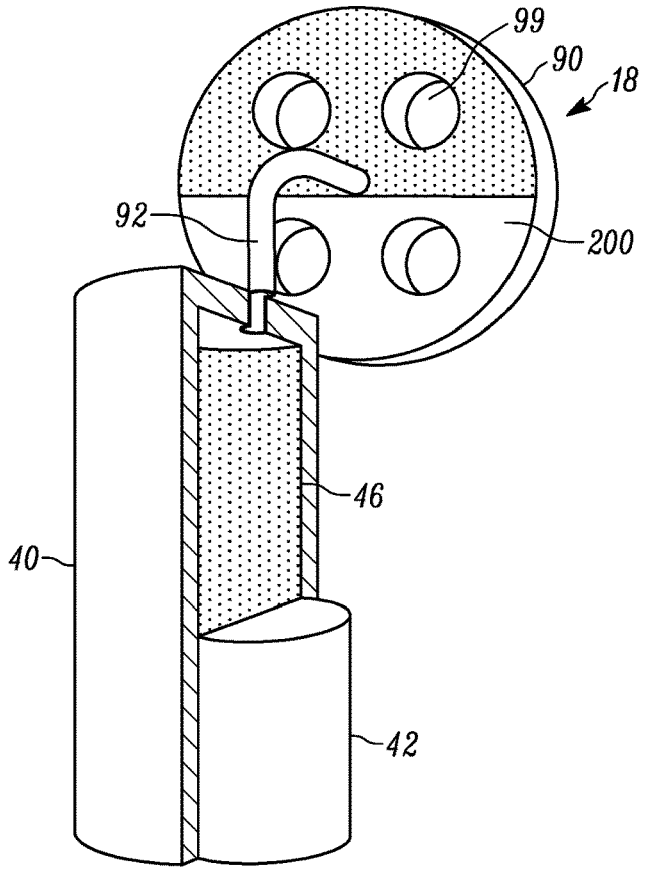
FIG. 7 illustrates a partial schematic cross-sectional view of a configuration of the example cylinder assembly and example heat exchanger assembly, showing the relative position of the heat exchanger relative to the cylinder assembly wherein the cylinder assembly is oriented substantially vertically and the central crankshaft is oriented substantially horizontally, when the cylinder assembly is in the top position during rotation, in accordance with a possible embodiment.
Figure 8:
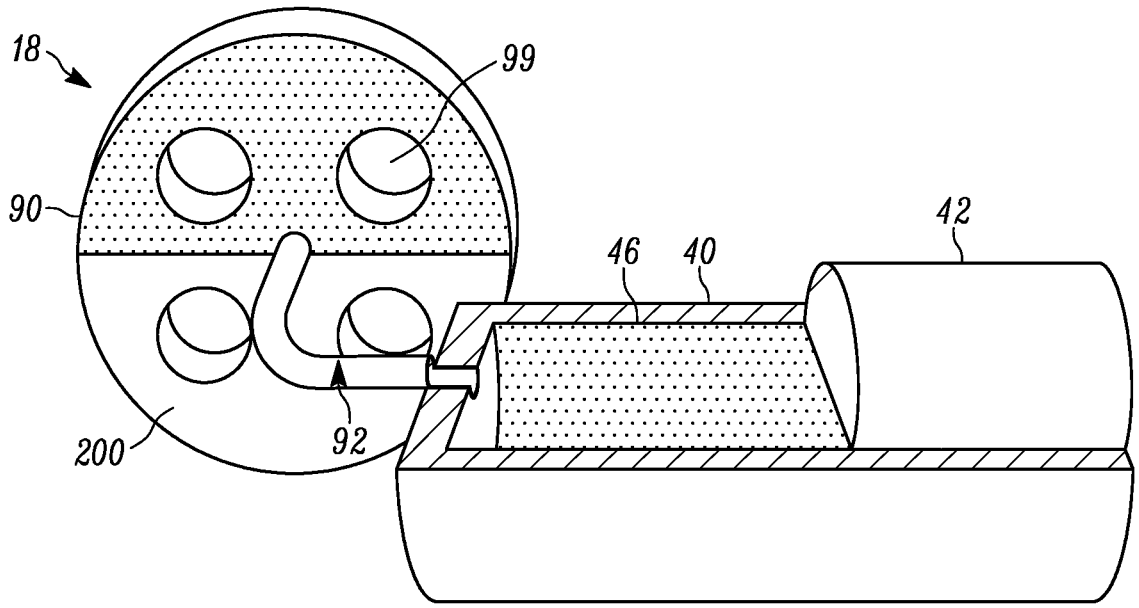
FIG. 8 illustrates a partial schematic cross-sectional view of the configuration shown in FIG. 7, when the cylinder is in a horizontal orientation along its rotative travel about the central crankshaft, in accordance with a possible embodiment.

As can be seen in FIGS. 6 through 8, it is contemplated that the connecting pipe is coupled to the heat exchanger body 90 in such a configuration that, with the aid of gravity and the like, the refrigerant 200 that remains in a liquid state generally remains in the heat exchanger body and its passage through the connecting pipe and into the cylinder member 40 is minimized. In some configurations, the connecting pipe may be pivotably coupled to the cylinder member 40, so that relative rotation is permitted. In such a configuration, through the force of gravity and the like, the coiled hose heat exchanger body 90 can remain in a position that substantially precludes the passage of liquid refrigerant 200 into the cylinder member 40. This configuration allows any liquid refrigerant 200 that makes its way into the cylinder member 40 to be drawn back in the heat exchanger body 90, like a vacuum when the pressure drops within the cylinder member 40 when moving into the cold region 39*b*.

It will be understood that a number of different refrigerants can be utilized for the refrigerant 200. In some configurations a hydrofluorocarbon (HFC) refrigerant such as R134 may be utilized. A number of other refrigerants are also contemplated including different CFC, CFO, HCFC, HCFO, HFC, HFO, HCC, HCO, HC, HO, and other refrigerant types. It has been found that R134 can be utilized with effective results. However, the disclosure is not limited to any particular refrigerant, and a number of different refrigerants from a number of different classes or types of refrigerants is contemplated. These refrigerants have a phase change between a liquid and a gas at desired temperature ranges, which may be dictated by the environment in which the rotary heat engine is placed. Although this application does not claim priority to U.S. Provisional Application No. 62/178,211, the details relative to the phase change and operation is fully explained in that provisional application, which provisional application is incorporated herein by reference in its entirety.

As noted in the provisional, a number of different configurations are contemplated for each of the central crankshaft, the radial cylinder coupling, the cylinder assemblies and the heat exchanger assembly. The central crankshaft can be positioned so that the axis of rotation is vertical, horizontal or oblique to the vertical and the horizontal. Additionally, a number of different configurations and sizes for the cylinder assembly are contemplated, as well as a number of different quantities of cylinder assemblies.

Finally, a number of different configurations are contemplated for (as well as sources of) the source of heat for the heat region and the source of cooling for the cooled region. A number of these are set forth in the provisional application, and the disclosure is not limited to any such sources. The disclosure is not limited to any such sources. With the desire to create a difference in temperature between the heat region and the cooled region, it will be understood to one of ordinary skill in the art that such sources may comprise any number of different sources, limited perhaps by the availability of such sources.

It has been determined that, in some embodiments, an odd number of cylinder members 40 be utilized. In particular, as an odd number, only a single cylinder will be transitioning between the hot and cooled regions 39*a*, 39*b*, respectively, of the system 100 at a given time. This places less stress on the system because only one cylinder assembly 16 is required to overcome the barrier between hot and cold at a time. Where there is an even number of cylinder assemblies 16, in most configurations, one cylinder assembly 16 will be transitioning from the cold region of the system to the hot region 39*a* while another cylinder assembly 16 is transitioning from the hot region 39*a* of the system 100 to the cold region 39*b* of the system 100. Of course, the system 100 is not limited to such a configuration, however, it has been found that such a configuration has benefits.

Furthermore, regardless of the configuration, a consideration is the minimization of liquid refrigerant 200 entering into the cylinder assembly 16. There are a number of efficiency reasons, and operational reasons for maintaining the liquid refrigerant 200 within the inner chamber of the heat exchanger body 90. First, less liquid refrigerant 200 will be available in the inner chamber of the heat exchanger which limits the amount that is available for phase change to a gas, thereby reducing efficiency. Additionally, at some point, if sufficient amounts of liquid refrigerant 200 pass into the cylinder assembly 16, there will not be sufficient remaining refrigerant 200 to gasify and to provide sufficient pressure to move the piston relative to the cylinder member 40, thereby causing the cylinder to cease operating, which, eventually, if the same occurs in other cylinder assemblies 16, leads to the rotary heat engine 10 failing to operate.

Figure 5:
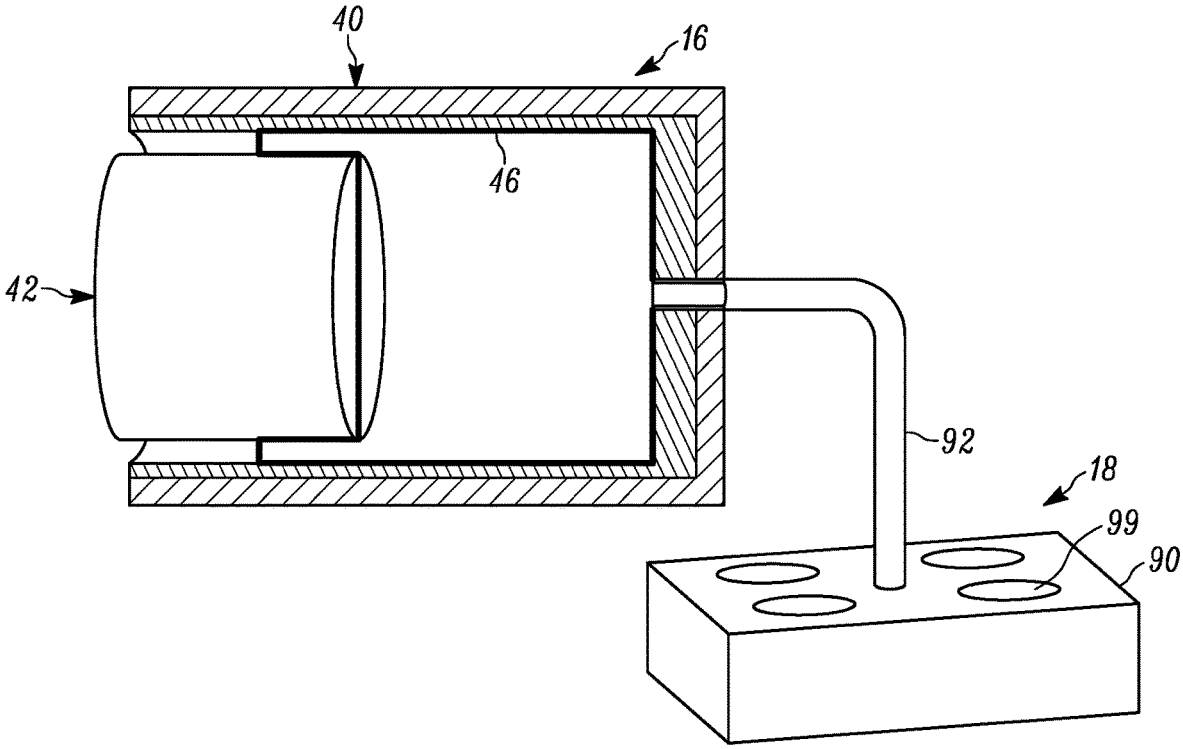
FIG. 5 illustrates a partial schematic cross-sectional view of a configuration of the example cylinder assembly and example heat exchanger assembly, showing the relative position of the heat exchanger relative to the cylinder assembly wherein the cylinder assembly is oriented substantially horizontally (and the central crankshaft is oriented substantially vertically), and showing insulation extending about the outside of the cylinder member, and along the inside surface of the distal end wall, in accordance with a possible embodiment.

With reference to FIGS. 5 and 6, with a horizontally positioned cylinder assembly 16 (i.e., when the central crankshaft 12 is positioned substantially vertically or predominantly vertically), the heat exchanger body 90 can be positioned below the cylinder assembly 16, and relying on gravity to maintain the liquid refrigerant 200 within the heat exchanger body 90, while allowing the gas refrigerant 200 to pass through the connecting pipe 92 and into the cylinder assembly 16.

In a vertical position (i.e., when the central crankshaft 12 is positioned substantially horizontally or predominantly horizontally), the level of refrigerant 200 preferably remains below the heat exchanger end 97 of the connecting pipe 92 in each position along the path of movement. For example, and with reference to FIG. 7 at the top of the cylinder assembly 16 position, the liquid refrigerant 200 remains below the heat exchanger end 97 of the connecting pipe 92, thereby relying on gravity to maintain the liquid refrigerant 200 within the heat exchanger body 90. With reference to FIG. 8, as the cylinder assembly 16 approaches and reaches a horizontal orientation, due to the configuration of the heat exchanger body 90 and the connecting pipe 92, the liquid refrigerant 200 remains below the heat exchanger end 97 of the connecting pipe 92, again maintaining the liquid refrigerant 200 within the heat exchanger body 90.

Figure 9A:
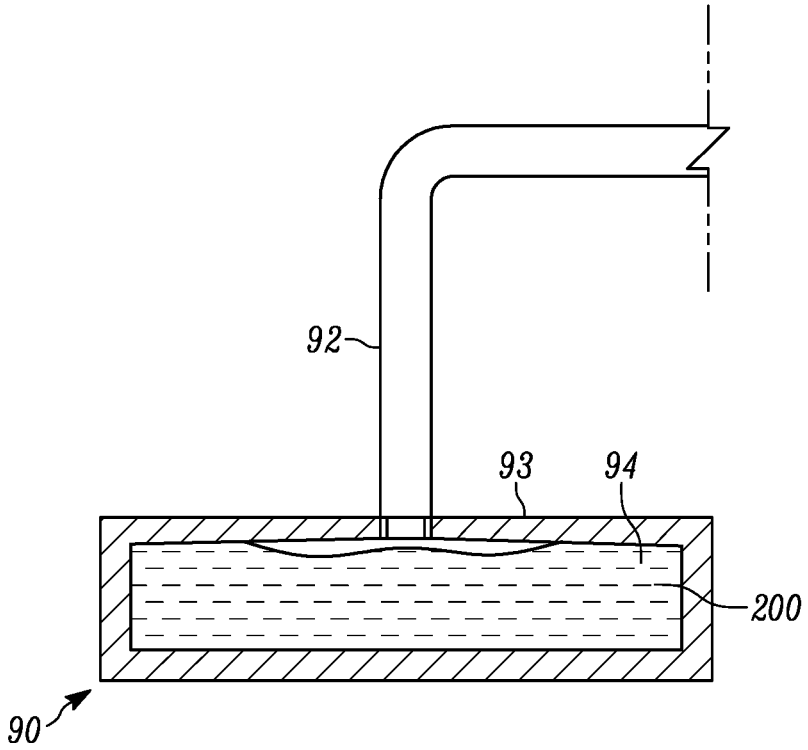
FIGS. 9A and 9B illustrate a partial schematic cross-sectional view of the configuration shown in FIG. 8, when the cylinder is in a horizontal orientation along its rotative travel about the central crankshaft, according to a possible embodiment.
Figure 9B:
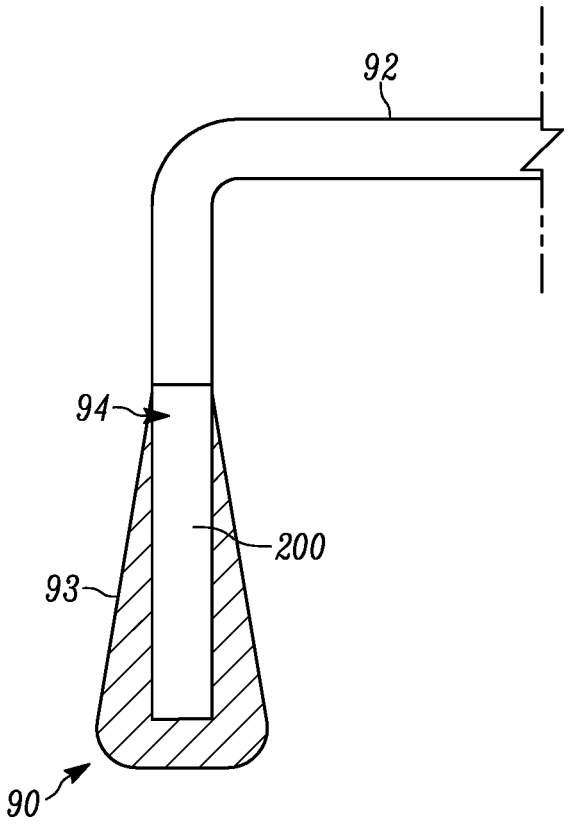

It is further contemplated that the structure of the heat exchanger body 90 can be varied so as to favor the greatest exchange of heat to the refrigerant 200 that is closest to the connecting pipe 92 to boil first and to change phase to a gas phase. One manner in which to achieve the same, and with reference to FIGS. 9*a* and 9*b*, is to decrease wall thickness of the heat exchanger body 90 proximate the connecting pipe 92, and to increase the wall thickness of the heat exchanger body 90 away from the connecting pipe 92. In that manner, substantially even heating of the heat exchanger body 90 will result in the greatest transfer of heat to the portion of the liquid refrigerant 200 that is closest to the connecting pipe 92. A number of different configurations are contemplated and other manners are also considered, such as varying the material from which the heat exchanger body 90 is made along the body thereof, so that greater heat transfer occurs closer to the connecting pipe 92, to, in turn, heat up the liquid refrigerant 200 closest to the connecting pipe 92 the fastest.

Figure 10:
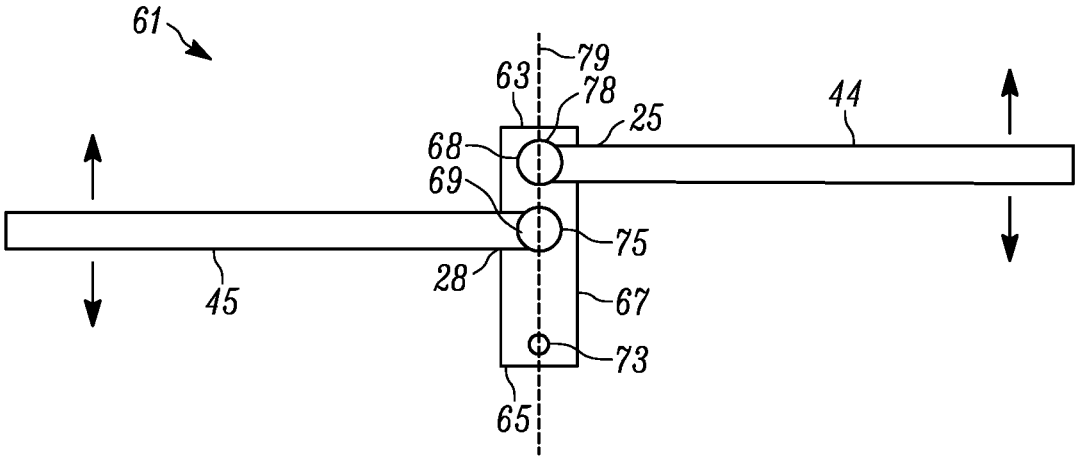
FIG. 10 illustrates an example piston coupler for use with the rotary heat engine, according to a possible embodiment.

FIG. 10 illustrates an example piston coupler 61 for use with the rotary heat engine 10. In some embodiments the intermediate piston coupler 13 can be configured in accordance with the piston coupler 61 illustrated in FIG. 1. The piston coupler 61 is comprised a force transfer member 67 that includes a first end 63 and a second end 65. Two attachment points 68 and 69 are disposed proximate to the first end 63 of the force transfer member 67. A pivot point 73 is disposed proximate to the second end 65 of the force transfer member 67. The distal end 78 of the first connecting rod 44 is coupled to the attachment point 68 and the distal end 75 of the second connecting rod 45 is coupled the attachment point 69. Thus, mechanical pulling and pushing forces on the first connecting rod 44 are transferred to the second connecting rod 45 via the force transfer member 67, causing the force transfer member 67 to pivot about the pivot point 73. The distance between the two attachment points 68 and 69 translates these mechanical forces into offset forces. The offset forces allow the intermediate piston coupler 61 to substantially eliminates side loading, that is pushing of the piston member 42 against the rolling diaphragm 46 (FIGS. 3, 4A-4C) within the cylinder assembly 16. Moreover, the intermediate piston coupler 61 reduces the pivot angle of the piston member 42 (FIG. 4A-4C) relative to the cylinder member 40. Furthermore, the intermediate piston coupler 62 allows for stroke multiplication or reduction.

In some embodiments, the two attachment points 68 and 69 are proximate to each other. In other embodiments, the two attachment points 68 and 69 are spaced apart. In some embodiments, the distal ends 75 and 78 are coupled to the force transfer member 67 along a common axis 79. In some embodiments, the pivot point 73 of the force transfer member 67 is coupled to a common structure (not shown) to which the radial cylinder coupling 14 is coupled. In other embodiments, the pivot point 73 of the force transfer member 67 is coupled to radial cylinder coupling 14. FIG. 10 illustrates but one example of an intermediate piston coupler 13 using a force transfer member 67. Other examples include an intermediate piston coupler 13 that comprises a linear bearing.

Figure 11:
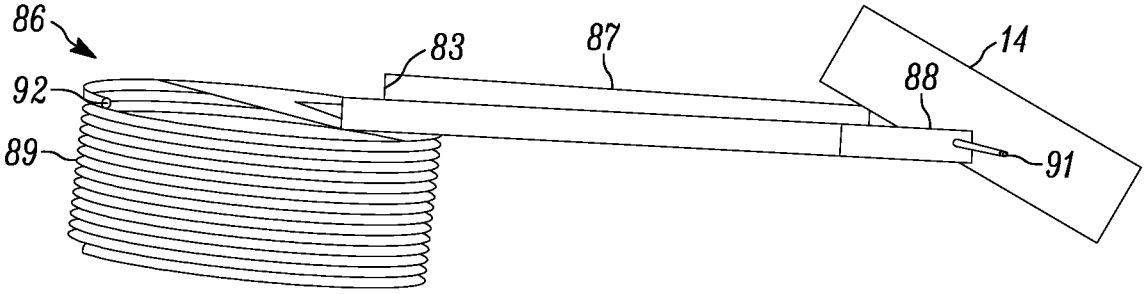
FIG. 11 illustrates another example of a heat exchanger, according to a possible embodiment for use with the rotary heat engine, according to a possible embodiment.

FIG. 11 illustrates another example of a heat exchanger 86 for use with the rotary heat engine 10. In this example, the heat exchanger 86 comprises a coiled pipe 89 forming coil shape. In some embodiments, a portion of this coiled pipe 89 can form the connecting pipe 92. In some embodiments, the coiled pipe 89 is coupled to a pivoting member 87. The pivoting member 87 includes a first end 83 and a second end 88. The coiled pipe 89 is coupled to the first end 83 of the pivoting member 87. The second end 88 of the pivoting member 87 can be coupled to the radial cylinder coupling 14 to act like a hinge, such that the coiled pipe 89 can pivot about pivot point 91 to move the coiled pipe 89 within the environment 39 to optimize heat transfer to and away from the coiled pipe 89.

Figure 12A:
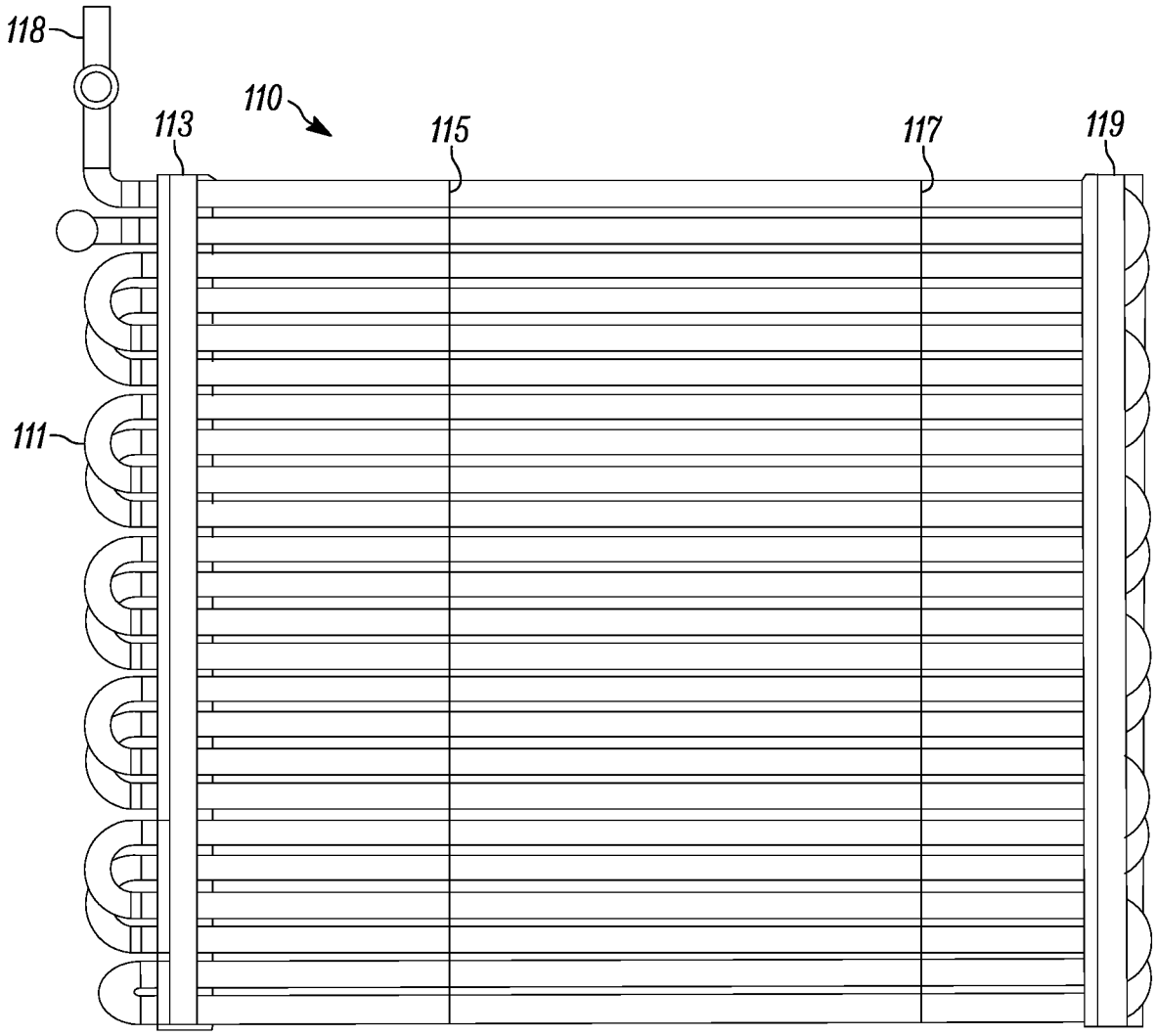
FIGS. 12A through 12E illustrates yet another example heat exchanger for use with the rotary heat engine, according to a possible embodiment.
Figure 12B:
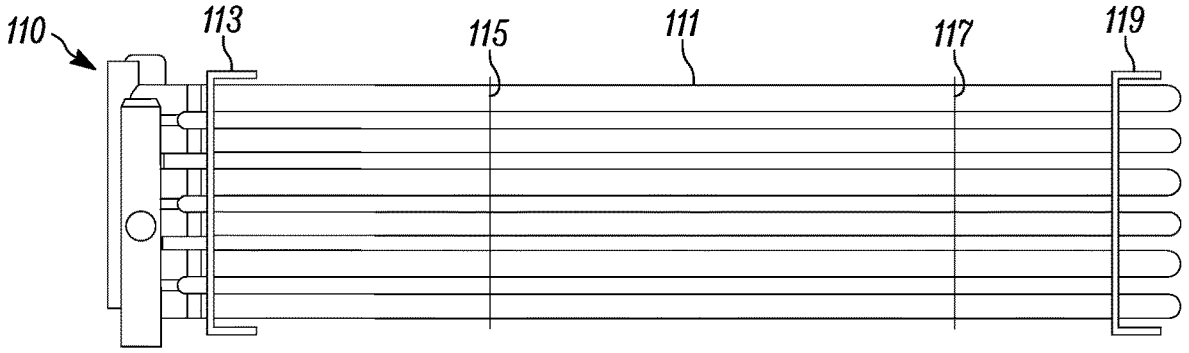
Figure 12C:
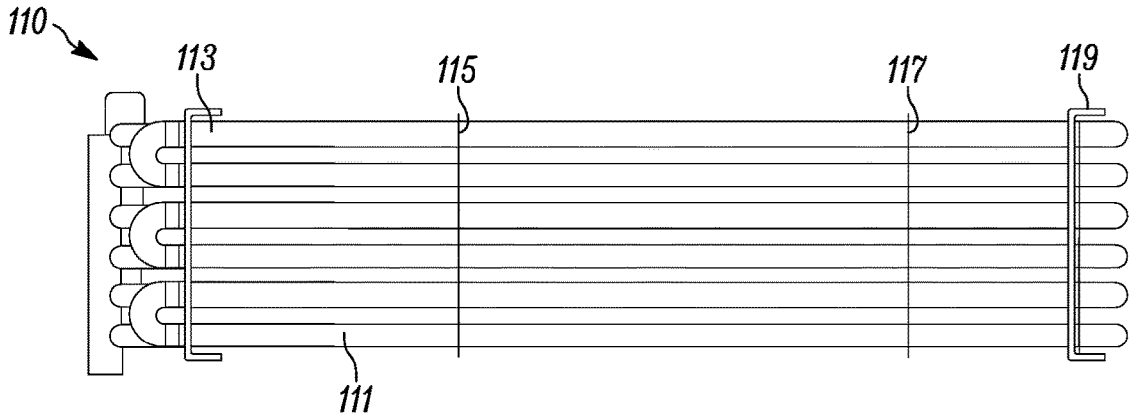
Figure 12E:
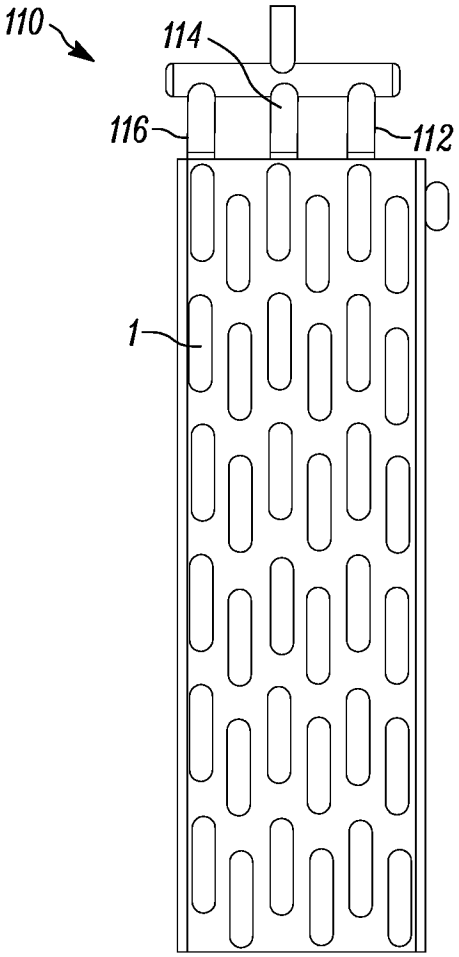
Figure 12D:
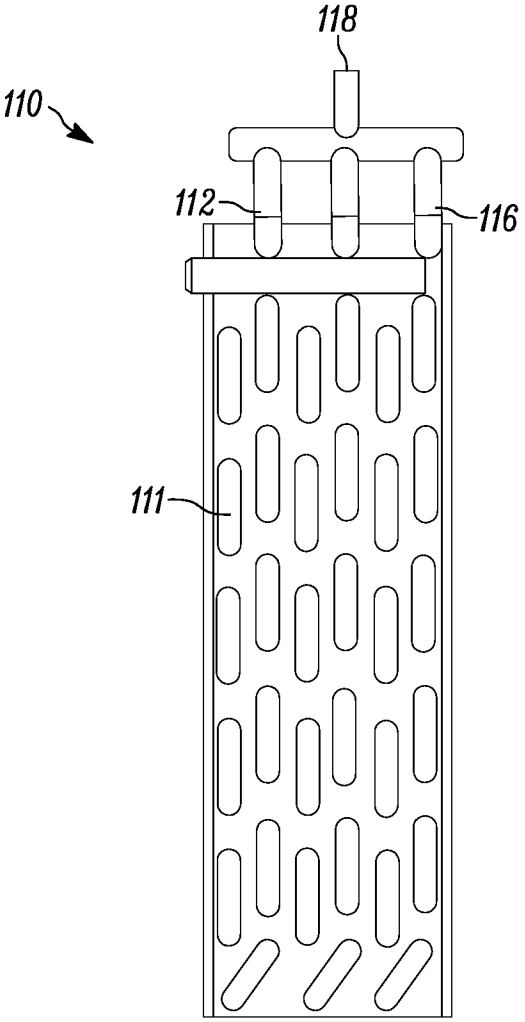

FIGS. 12A through 12E illustrate yet another example heat exchanger 110 for use with the rotary heat engine 10. In particular, FIG. 12A illustrates a front view of the heat exchanger 110, FIG. 12B illustrates a top view of the heat exchanger 110, FIG. 12C illustrates a bottom view of heat exchanger 110, FIG. 12D illustrates a left view of heat exchanger 110, and FIG. 12E illustrates a right side view of heat exchanger 110. In this example, the heat exchanger 110 is approximately an elongated narrow box comprising pipe 111 formed from three (3) pipe segments 112, 114, 116 that are bend into the elongated narrow box shape. Coupling these pipe segments 112, 114, 116 together is a joining pipe 118. The joining pipe 118 is coupled to the connecting pipe 92. The use of such a parallel configuration of the three (3) pipe segments 112, 114, 116 illustrated in FIGS. 12A through 12E improves the thermal properties of the heat exchanger 110, resulting in improved output power from the rotary heat engine 10 utilizing the heat exchanger 110. In some embodiments, the heat exchanger 110 can be formed from a single pipe to form the elongated narrow box of pipe 111, eliminating the joining pipe 118. Various rigidity members 113, 115, 117, 119 can be used at the ends and between thereof to maintain rigidity within the heat exchanger 110.

Figure 13:
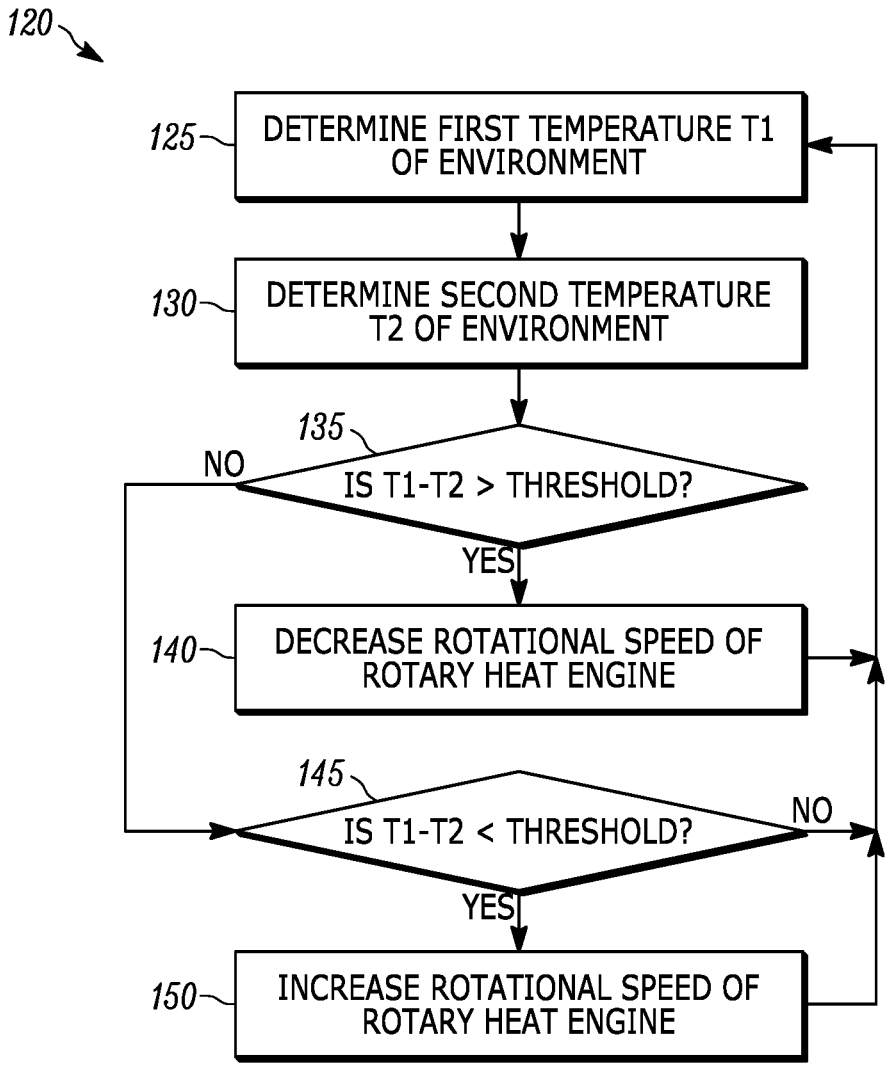
FIG. 13 illustrates an example flowchart illustrating operation of an apparatus such as a controller for maximizing efficiency of the rotary heat engine, according to a possible embodiment.

FIG. 13 illustrates an example flowchart 120 illustrating operation of an apparatus, such as the controller 20, for maximizing efficiency of the rotary heat engine 10. Likewise, such maximizing efficiency of the rotary heat engine 10 also improves an efficiency of the hot region 39*a* of the environment 39. At 125, the flowchart 120 makes a determination as to a first temperature T1 of the environment 39, such as the hot region 39*a*, within which the rotary heat engine 10 operates. This determination is made at a first time t1. In some embodiments, the controller 20 determines the temperature T1 of the environment 39, such as the hot region 39*a*, by receiving signals from the temperature sensor 15 that correspond to the temperature T1 of the environment 39.

At 130, another determination is made as to a second temperature T2 of the environment 39 within which the rotary heat engine 10 operates. This determination is made at a second time t2. In some embodiments, the controller 20 determines the temperature T2 of the environment 39 by receiving signals from the temperature sensor 15, such as temperature sensor 39*a*, that correspond to the temperature T2 of the environment 39, such as the hot region 39*a*.

At 135, yet another determination is made as whether the temperature difference over time for the environment 39, such as the hot region 39*a*, is either increasing or decreasing. In some embodiments, the controller 20 subtracts the first temperature T1 from the second temperature T2. If this subtracted amount is greater than a threshold amount, 135 branches to 140. In some embodiments, the controller 20 compares this subtracted amount to the threshold amount to make the determination in 135. Otherwise, 135 branches to 145. As used throughout, the described thresholds are described as positive thresholds herein, but can be either positive thresholds or negative thresholds, with the described associated parameters that are being modified based on such positive thresholds being opposite parameters for negative thresholds. For example, increasing a parameter for a positive threshold equates to decreasing the parameter for a negative threshold, and decreasing a parameter for a positive threshold equates to increasing the parameter for a negative threshold.

At 140, a rotational speed of the rotary heat engine 10 is decreased. In some embodiments, the controller 20 modifies, for example decreases, the rotational speed of the rotary heat engine 10 which reduces the amount of power being produced by the rotary heat engine 10. Likewise, the amount of heat being absorbed by the heat exchanger body 90 from the environment 39, such as the hot region 39*a*, within which the rotary heat engine 10 operates is reduced. The controller 20 can adjust at least one of an analog control and a digital control of the rotational speed of the rotary heat engine 10. After adjusting the rotational speed of the rotary heat engine 10, 140 branches to 125 to continue monitoring for temperatures changes within the environment 39, such as the hot region 39*a*, over time.

In some embodiments in which the controller 20 is only determining a temperature of the hot region 39*a*, 135 can include use of a plurality of thresholds before branching to 140, where 140 can include control of a plurality of rotational speeds for the rotary heat engine 10. For example, if the temperature of the hot region 39*a* is greater than 120° F., then the controller 20 adjusts the speed of the rotary heat engine 10 to a first rotational speed. If the temperature of the hot region 39*a* is greater than 125° F., then the controller 20 adjusts the speed of the rotary heat engine 10 to a second rotational speed. If the temperature of the hot region 39*a* is greater than 130° F., then the controller 20 adjusts the speed of the rotary heat engine 10 to a third rotational speed. This example describes adjustments for rising temperatures within the hot region 39*a*, however such principles also apply to falling temperatures within the hot region 39*a* which would result in the controller 20 likewise adjusting the rotational speeds for the rotary heat engine 10 for such falling temperatures within the hot region 39*a*. Although three rotational speeds are described in this example, the controller 20 can adjust the speed of the rotary heat engine 10 to any number of rotations speeds. Also, these are just example resolutions, with the resolutions be tunable to be as fine or as course as desired, based on the particular application of the rotary heat engine 10. Although the example illustrates changing rotational speeds for increasing temperatures, the same principles apply to changing rotational speed in an opposite direction for decreasing temperatures. In some embodiments, there are an infinite number of resolutions, with the controller 20 making continuous modifications to the rotational speed of the rotary heat engine 10 for such temperatures.

In some embodiments in which the controller 20 is determining a temperature of the hot region 39*a* and the cold region 39*b*, 135 can include the controller 20 determining a temperature difference between the hot region 39*a* and the cold region 39*b* and use of a plurality of thresholds before branching to 140, where 140 can include control of a plurality of rotational speeds for the rotary heat engine 10. For example, if the temperature difference between the hot region 39*a* and the cold region is greater than 50° F., then the controller 20 adjusts the speed of the rotary heat engine 10 to a first rotational speed. If the temperature difference between the hot region 39*a* and the cold region is greater than 55° F., then the controller 20 adjusts the speed of the rotary heat engine 10 to a second rotational speed. If the temperature difference between the hot region 39*a* and the cold region is greater than 60° F., then the controller 20 adjusts the speed of the rotary heat engine 10 to a third rotational speed. Although three rotational speeds are described in this example, the controller 20 can adjust the speed of the rotary heat engine 10 to any number of rotations speeds. Also, these are just example resolutions, with the resolutions be tunable to be as fine or as course as desired, based on the particular application of the rotary heat engine 10. Although the example illustrates changing rotational speeds for increasing temperature differences, the same principles apply to changing rotational speed in an opposite direction for decreasing temperature differences. In some embodiments, there are an infinite number of resolutions, with the controller 20 making continuous modifications to the rotational speed of the rotary heat engine 10 for such temperature differences.

In some embodiments, 140 comprises either increasing or decreasing a duty cycle percentage of the power converter 21. The controller 20 modifies the duty cycle percentage of the power converter 21 which either increases or decreases the amount of power being produced by the power converter 21, such as the various rotational speeds of the rotary heat engine 10 discussed above. Likewise, the amount of heat being absorbed by the heat exchanger body 90 from the environment 39 within which the rotary heat engine 10 operates is either increased or reduced and results in increased or decreased rotation speed of the rotary heat engine 10. For example, the controller 20 can increase the duty cycle percentage of the power converter 21 to decrease a rotational speed of the rotary heat engine 10, and vice versa. At 145, yet another determination is made as whether the temperature difference over time for the environment 39 is either increasing or decreasing. In some embodiments, the controller 20 subtracts the first temperature T1 from the second temperature T2. In some embodiments, the controller 20 compares this subtracted amount to a threshold amount to make the determination in 145. For example, if T1 is 120° F. and T2 is 130° F., then T1-T2 would be −10° F., which means the temperature of the environment 39 is increasing and would be compared against a negative threshold. In some embodiments, T2 can be likewise subtracted from T1 and compared against a positive threshold. If this subtracted amount is less than the threshold amount, 135 branches to 150. Otherwise, the temperature within the environment 39 has not changed beyond the threshold amount and 145 branches to 125 to continue monitoring for temperatures changes within the environment 39 over time. In some embodiment the threshold amount in 135 is the same threshold amount in 145. In other embodiments, the threshold amount in 135 is a different threshold amount from 145, such as a second threshold amount. In some embodiments, the threshold amount in 135 is a first threshold amount and the threshold 145 is a second threshold amount of a different value. In other embodiments, the threshold amount in 135 and 145 are the same threshold amount.

In some embodiments, 140 includes the controller 20 controls the braking system 7 to reduce the rotational speed of the rotary heat engine 10. As discussed above, the controller 7 activates the braking system 7 to apply various braking forces to the rotary heat engine 10 to reduce the rotational speed of the rotary heat engine 10. For example, should the rotational speed of the rotary heat engine 10 be great, the controller 20 activates the braking system 7 to apply a greater amount of braking force to the rotary heat engine 10 to reduce the rotational speed, and vice versa.

At 150, the rotational speed of the rotary heat engine 10 is increased. In some embodiments, the controller 20 modifies, for example, increases, the rotational speed of the rotary heat engine 10 which increases the amount of power being produced by the power converter 21. Likewise, the amount of heat being absorbed by the heat exchanger body 90 from the environment 39, such as the hot region 39*a*, within which the rotary heat engine 10 operates is increased. After adjusting the rotational speed of the rotary heat engine 10, 150 branches to 125 to continue monitoring for temperatures changes within the environment 39, such as the hot region 39*a*, over time. The controller 20 can adjust at least one of an analog control and a digital control of the rotational speed of the rotary heat engine 10.

In some embodiments, 150 comprises decreasing a duty cycle percentage of the power converter 21. The controller 20 modifies the duty cycle percentage of the power converter 21 which increases the amount of power being produced by the power converter 21. Likewise, the amount of heat being absorbed by the heat exchanger body 90 from the environment 39 within which the rotary heat engine 10 operates is increased and results in increasing a speed of rotation of the rotary heat engine 10.

Figure 14:
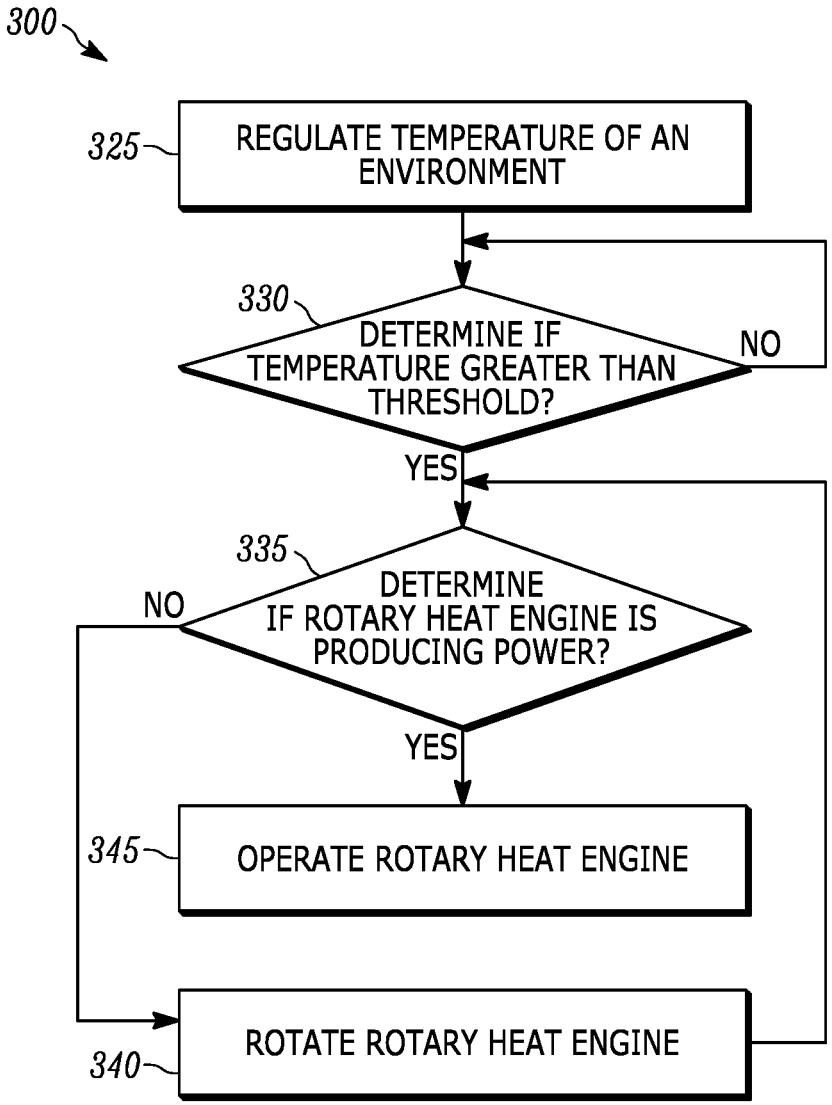
FIG. 14 illustrates another example flowchart illustrating operation of an apparatus such as a controller for starting the rotary heat engine while providing protection for temperature inversion, according to a possible embodiment.

FIG. 14 illustrates another example flowchart 300 illustrating operation of an apparatus such as a controller for starting, in some embodiments automatically, the rotary heat engine 10 while providing protection for temperature inversion, that is where a temperature of the cylinder assembly 16 is greater than a temperature of the hot region 39*a* by a threshold amount, this threshold amount being either the same or different than the threshold amount in flowchart 120. In 325, the flowchart 300 regulates a temperature of the environment 39. In some embodiments, the controller 15 increases a temperature of the hot region 39*a*, such as by turning on a first pump (not shown), such as a water pump, to begin increasing a temperature of the hot region 39*a*. In some embodiments, the controller 15 also turns on a second pump (not shown), such as a water pump, to regulate a temperature of the cold region 39*b*.

In 330, a determination is made as to whether a temperature $T_H$ of the hot region 39*a*, or a temperature difference between the hot region 39*a* and the cold region 39*b* is greater than an automatic start threshold. The controller 20 determines the temperature $T_H$ of the hot region 39*a* by receiving signals from the temperature sensor 15*a* that correspond to the hot region 39*a*. In some embodiments the controller 20 determines the temperature $T_C$ of the cold region 39*b* by receiving signals from the temperature sensor 15*b* that correspond to the cold region 39*b*. If the controller 15 determines that the temperature $T_H$ of the hot region 39*a* is greater than an automatic start threshold, 330 branches to 335. If the controller 15 also determines temperature $T_C$, in some embodiments, and also determines if the temperature difference between $T_H$ and $T_C$ is greater than the automatic start threshold, 330 branches to 335. Otherwise, 330 continues to determine whether the temperature difference between the temperature $T_H$ of the hot region 39*a* and the temperature $T_C$ of the cold region 39*b* is greater than the automatic start threshold. Alternatively, when the temperature $T_C$ of the cold region 39*b* is not being determined by the controller 15, the controller 15 in 330 continues to determine whether the temperature $T_H$ of the hot region 39*a* is greater than the automatic start threshold.

In 335, the controller 20 determines whether the rotary heat engine 10 is producing power, such as torque, e.g., on its own at the central crankshaft 12, as an indirect determination if the temperature inversion discussed above has occured, which prevents self stating, a scenario in which the rotary heat engine 10 cannot operated without external power being applied to the rotary heat engine 10. If the controller 20 determines that the power produced by the rotary heat engine 10 is greater than a threshold amount, 335 branches to 345. Otherwise, if the controller 20 determines that the power produced by the rotary heat engine 10 is not greater than the threshold amount, 335 branches to 340. In some embodiment, the controller 20 can monitor a sensor such as an optical sensor, an accelerometer, a hall effect sensor, or any other type of sensor that will allow a determination that the rotary heat engine 10 is producing power on its own at the central crankshaft 12.

In some embodiments in which the generator 19 is used to harness the power produced by the rotary heat engine 10, 335 includes the controller 15 monitoring the electrical current produced by the rotary heat engine 10. In such a scenario, the controller 20 reads a current (e.g., amps) being applied by the generator 19 to the battery 9. If the controller 20 determines that the current being supplied to the battery 9 is greater than a threshold current rated current charging threshold for the battery 9, 335 branches to 345. Otherwise, if the controller 20 determines that the current being supplied to the battery 9 is not greater than the threshold current for the battery 9, 335 branches to 340. In other embodiment, 335 can comprising the controller 15 monitoring a voltage or power produced by the generator 19.

At 340, the rotary heat engine 10 is rotated. In some embodiments, the controller 15 applies rotational power to the rotary heat engine 10 from an external power source 8. In some embodiments, the battery 9 is an external power source to rotate the rotary heat engine 10. The controller 20 controls rotation of the rotary heat engine 10 for a predetermined amount of time. Such rotation allows the heat exchanger assembly 18 to absorb heat from the hot region 39*a* of the environment 39. Thereafter, 340 branches to 335.

In some embodiments in which the generator 19 is used to harness the power produced by the rotary heat engine 10, 340 includes operating the generator 19 as a motor to turn the rotary heat engine 10 and remove heat from the cylinder assembly 16. As one skilled in the art understands, the generator 19 can operate as a motor when power is applied to the generator 19. In some embodiments, the controller 20 receives power from an external power source (not shown) to turn the rotary heat engine 10 to lower a temperature of the cylinder assembly 16. In some embodiments, the controller 20 turns the rotary heat engine 10 for a predetermined amount of time. Thereafter, 340 branches to 335.

In some embodiments 340 also includes heating with the cylinder assembly 81 with the heater 81. In such an instance, the controller 81 can also apply power to the heater 81 to heat the cylinder assembly 16 and warm refrigerant 200 in the cylinder assembly 16 to a temperature greater than a temperature of the refrigerant 200 in the heat exchanger body 90 thereby forcing the refrigerant 200 to condensate in the heat exchanger body 90.

At 345, the rotary heat engine 10 is operated, as described above, without the rotary heat engine 10 receiving either electrical power or mechanical power from an external source. In some embodiments in which the generator 19 is used to harness the power produced by the rotary heat engine 10, the controller 20 determines that the battery 9 is being charged in 335 as a basis for operating the rotary heat engine 10 without operating the generator 19 as a motor.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A rotary heat engine comprising:

a central crankshaft having a first end and a second end and defining an axis of rotation, the central crankshaft further including at least one piston attachment member having an offset axis which is offset from the axis of rotation, with at least one axially displaced coupling point about the offset axis;

a plurality of cylinder assemblies, at least one cylinder assembly including:

a cylinder member having an elongated structure defining a bore and including a top end and a bottom end, the cylinder member rotatably positioned about the central crankshaft so as to rotate about the axis of rotation, the cylinder member further including an opening proximate the top end;

a piston member slidably positionable within the bore;

a first connecting rod having a piston coupling end coupled to the piston member; and a rolling diaphragm positioned between the piston and the top end so as to define a working volume therebetween, the rolling diaphragm having a top end, a bottom panel and an elongated portion, the top end being sealingly attached to the cylinder member proximate the top end and in fluid communication with the opening therein, with the bottom panel overlying the piston so that movement of the piston rolls the elongated portion of the rolling diaphragm over itself between the piston and the bore of the cylinder member; and a heat exchanger assembly associated with the at least one cylinder assembly including:

a heat exchanger body having an outer surface and an inner chamber, the heat exchanger body having a refrigerant positioned within the inner chamber;

a connecting pipe having an inner bore, a heat exchanger end and a cylinder member end, the heat exchanger end coupled to the heat exchanger body, and the cylinder member end coupled to the opening in the cylinder member, thereby placing the inner chamber in fluid communication with the opening of the cylinder member, and the working volume of the rolling diaphragm through the opening; and a second connecting rod coupled to the at least one axially displaced coupling point of the at least one piston attachment member; and an intermediate piston coupler comprising a first attachment point and a second attachment point, the first attachment point of the intermediate piston coupler being coupled to the first connecting rod and the second attachment point of the intermediate piston coupler being coupled to the second connecting rod opposite an end of the second connecting rod coupled to the at least one axially displaced coupling point of the at least one piston attachment member.

2. The rotary heat engine of claim 1, further comprising a stabilizer bar coupled to the at least one piston attachment member, the stabilizer bar maintaining a constant substantially perpendicular orientation between the piston attachment member and the central crankshaft.

3. The rotary heat engine of claim 1 wherein at least a portion of the inner chamber of the heat exchanger body remains below the opening in the cylinder member, to in turn, preclude the passage of at least some refrigerant in a liquid state from the inner chamber to the working volume.

4. The rotary heat engine of claim 1 wherein the cylinder member further comprises a distal end wall at the top end of the elongated structure, with the top end of the rolling diaphragm being sandwiched between the distal end wall and the top end of the elongated structure in sealed engagement, and wherein the opening of the cylinder member extends through the distal end wall.

5. The rotary engine of claim 4 wherein the rolling diaphragm comprises a neoprene material.

6. The rotary engine of claim 1 wherein the piston member is smaller than the bore such that when the rolling diaphragm is positioned between the piston member and the bore of the cylinder member, the piston member is capable of pivoting relative to the bore, to, in turn, allow the connecting rod to pivot relative to the bottom end of the elongated structure of the cylinder member.

7. The rotary engine of claim 1 wherein the piston member of at least one of the plurality of cylinder assemblies is fixed to the respective at least one coupling point to preclude relative rotation therebetween.

8. The rotary engine of claim 1 wherein the plurality of cylinder assemblies comprises an uneven number of cylinder assemblies, spaced substantially uniformly about the piston attachment member.

9. The rotary heat engine of claim 1, wherein the intermediate piston coupler comprises a force transfer member to which the first connecting rod and the second connecting rod are coupled proximate to a first end thereof, the force transfer member pivoting proximate to a second end thereof.

* * * * *